US006655566B1

(12) United States Patent
Martin et al.

(10) Patent No.: US 6,655,566 B1
(45) Date of Patent: Dec. 2, 2003

(54) BUNDLE BREAKER IMPROVEMENT

(75) Inventors: Merrill D. Martin, Oakland, CA (US); Daniel J. Talken, Lafayette, CA (US)

(73) Assignee: Martin Family Trust, Oakland, CA (US)

( * ) Notice: Subject to any disclaimer, the term of this patent is extended or adjusted under 35 U.S.C. 154(b) by 0 days.

(21) Appl. No.: 10/229,891

(22) Filed: Aug. 28, 2002

(51) Int. Cl.[7] ..... B26F 3/02
(52) U.S. Cl. ..... 225/101; 225/102; 225/103
(58) Field of Search ..... 225/101, 100, 225/102, 103, 10, 96.5, 93, 106, 1

(56) References Cited

U.S. PATENT DOCUMENTS

| | | | | |
|---|---|---|---|---|
| 1,669,999 A | | 5/1928 | Olsen | |
| 2,171,769 A | | 9/1939 | Stolar et al. | |
| 3,286,893 A | | 11/1966 | Zellers, Jr. | |
| 3,517,869 A | | 6/1970 | Dryon | |
| 3,658,220 A | | 4/1972 | Norton | |
| 4,136,604 A | * | 1/1979 | Schmidt | 493/340 |
| 4,171,081 A | | 10/1979 | Vossen et al. | |
| 4,500,022 A | * | 2/1985 | Lucas | 225/97 |
| 4,714,035 A | * | 12/1987 | Engle | 112/114 |
| 4,987,723 A | * | 1/1991 | Diemer | 53/399 |
| 5,069,195 A | | 12/1991 | Barozzi | |
| 5,791,038 A | * | 8/1998 | Libert et al. | 29/596 |
| 5,810,156 A | | 9/1998 | Siebels | |
| 5,865,358 A | * | 2/1999 | Fernandez | 225/101 |
| 5,927,582 A | * | 7/1999 | Duecker | 225/2 |
| 6,019,267 A | * | 2/2000 | Shill et al. | 225/101 |

FOREIGN PATENT DOCUMENTS

EP 1 292 067 B2 11/1988

OTHER PUBLICATIONS

Pallmac Brochure; Pallmac Omni–Seperator For Your Rotary Or Flatbed Diecutter (4pgs) Ashland, Virginia and Brugge, Belgium.

* cited by examiner

*Primary Examiner*—Allan N. Shoap
*Assistant Examiner*—Ghassem Alie
(74) *Attorney, Agent, or Firm*—James R. Cypher; Charles R. Cypher

(57) ABSTRACT

An improvement in a bundle breaker having first and second adjacent but longitudinally spaced upper and lower clamping surfaces for breaking progressively a bundle of sheets along a weakened plane from a log. The improvement includes first and second compliance structures positioned between the first and second upper and lower clamping surfaces. The first and second compliance structures include a device for detecting the height of the log and a variation setting device for reducing the distance between the upper and lower clamping surface a selected increment after detecting the height of the log. The compliance structures preferably include fluid pressurized structures which not only detect the height of the highest log when a plurality of logs in side by side relation are broken simultaneously but also apply even pressures to all of the logs and bundles during clamping and breaking even though one or more may have different heights.

17 Claims, 18 Drawing Sheets

BUNDLE BREAKER IMPROVEMENT

BACKGROUND OF THE INVENTION

This invention relates to an improvement in machines, commonly referred to as bundle breakers or bundle separators, which separate a plurality of stacked sheets, hereafter a bundle, from a plurality of stacked sheets, hereafter referred to as a log. Each sheet is divided by one or more weakened lines and each log is divided by one or more weakened planes. Bundle breakers in the corrugated board industry are typically located in a production line between a sheet stacker on the upstream side and a load former which arranges the bundles in pallet loads on the downstream side.

A wide variety of products are manufactured in elongated sheets and divided into smaller segments as by scoring, indenting, nicking, tabbing or punching; creating weakened planes in the material. Such products include composition house roofing shingles, glass plates, paper, plastic, and corrugated board used in constructing boxes and packaging material Early machines in the above designated categories, separated small segments from a larger sheet. Examples include: Olsen U.S. Pat. No. 1,669,999, 1928 for composition shingle; Stolar, U.S. Pat. No. 1,171,769, 1939, paper sheet; Zellers, U.S. Pat. No. 3,286,89, glass sheet; Dryon, U.S. Pat. No. 3,517,869, 1970, glass sheet using tilting table; Norton, U.S. Pat. No. 3,658,220, 1972, cardboard sheet; Barozzi, U.S. Pat. No. 5,069,195 1991; and Vossen, U.S. Pat. No. 4,171,081, 1979, cardboard sheet.

As the speed of machines creating long strips of sheet material increased and the advantages of arranging the sheet material into stacks became apparent, machines were developed for separating a plurality of sheets or a bundle from the stack of sheets or log. Each log was separated into a plurality of bundles. Separation, was effected by aligning the weakened planes of each sheet into a single vertical plane. The first machines, such as Schmidt, U.S. Pat. No. 4,136,604, 1979 applied clamps on either side of the weakened plane and effected separation of the bundles from the log by applying force downwardly on the bundle side of the weakened plane. This method required tremendous punching force since all of the sheets were essentially separated at the same time. The use of high force as used by Schmidt compressed and often damaged the cardboard sheets in the separation process.

Lucas, U.S. Pat. No. 4,500,022, 1985 introduced progressive tearing force along the weakened plane thereby reducing the punching force of Schmidt and reducing damage to the cardboard.

Fernandez, U.S. Pat. No. 5,865,358, 1999 introduced progressive tearing in a cardboard bundle by maintaining the bundle and log in a horizontal plane and pivoting the bundle about a vertical axis away from the log.

Vanhoutte, of Brugge Belgium, European patent 292 067, 1994, application published 1988, patented a cardboard bundle breaker which progressively severed the cardboard bundle from the log by pivoting the bundle portion downward about a horizontal pivot axis.

Pallmac , of Brugge, Belgian, installed a bundle breaker of cardboard sheets in Sanger, Calif. USA in 1994. The Pallmac machine progressively severed the cardboard bundle from the log by pivoting the bundle portion downward about a horizontal pivot axis.

Duecker, U.S. Pat. No. 5,927,582 was granted U.S. Pat. No. 5,927,582 in 1999 on a patent application filed Aug. 5, 1997 which did not cite the Pallmac bundle breaker, supra or the Vanhoutte bundle breaker supra. Duecker progressively severed the cardboard bundle from the log by pivoting the bundle portion upward about a horizontal pivot axis.

Shill, U.S. Pat. No. 6,019,267, in 2000 progressively separated a bundle from a log by progressively tearing the bundle starting at a point and pivoting the bundle along an X and a Y plane. By progressively simultaneously tearing along two planes, the clamping force required to hold the cardboard bundles was further reduced.

In order to speed production, Pallmac, 1994, e.g. feeds two or more logs through its bundle breaker and severs a plurality of bundles simultaneously from the side by side logs. One of the problems associated with breaking multiple bundles from multiple logs is that one or more logs may be higher than the others due to a miscount in the number of sheets or the accidental insertion of scrap pieces of material between one or more sheets of the log. It is sometimes possible that where there are three or more logs, all may have different heights.

When both top and bottom surfaces of the clamps are rigid, more pressure is exerted on the taller logs which can damage compressible material like corrugated cardboard. If the logs are not compressible, then insufficient pressure is placed on the shorter logs and shifting of the logs can occur when the bundles are broken off from the log either by pivoting the bundle about a horizontal or vertical axis or a combination of both. In the industry, this problem is called a "lack of compliance" problem; i.e. the force on all the side by side logs is not substantially equal.

To solve the lack of compliance problem some companies have inserted spring material such as foam between the face of the rigid clamp and the logs. Springs and foam rubber do not distribute the clamp force evenly between side by side logs. Springs and foam materials increase pressure with displacement.

Pallmac sought to solve the compliance problem by placing a small diameter elongated air bag below the rigid lifting members near the break line of the bundle breaker and at right angles to the direction of flow of the material.

Pallmac uses a plurality of narrow spaced apart conveyor belts and lifting members which are located between each belt. The Pallmac air bag is part of the lifting mechanism. Before a bundle can be broken from a log, the lifting mechanism must lift the log up into engagement with the upper hard vertically adjustable fixed clamp. Since the length of the log often exceeds the length of the lifting members, the portion of the log hanging off the end of the lifting members will no longer be horizontal. As the lifting members lower the log, a shifting of the individual sheets within the log can occur which changes the position of the weakened plane and can result in failure to break the bundle cleanly from the log or produce poorly formed bundles. As the variation in the logs increase, the upper hard vertically adjustable clamp needs to be adjusted upward, which increases the shifting effect of the individual sheets.

Siebels, provided vibration damping in a vibratory table for separating sheets of glass which have become stuck to one another in an annealing process by providing an air bag 62 (see FIG. 3). This use of an air bag has no relevance in solving the compliance problem when logs of uneven height are to be broken.

SUMMARY OF THE INVENTION

The essence of the invention is the provision of a fluid pressure compliance structure to provide reliable breaking of multiple side-by side bundles from multiple side by side logs by applying equal pressure to all of the logs and severed bundles.

Wherever the words "fluid pressure" are used in this application, the word "fluid" includes liquid as well as gas. Liquids may include water or other fluids. The word "gas" includes air as well as other gases. Applicants found that air is the preferred fluid for applications in the corrugated board industry.

It is an object of the present invention to provide a compliance structure which can be used in breaking bundles from logs which are composed of sheets of corrugated board.

It is a further object to provide a device which can also be used in breaking sheets of different materials arranged in logs such as glass, roof shingle materials made from various composition materials, sheets of plastic arranged in logs, and other sheet material formed in stacks in which the logs contain one or more weakened planes.

It is a further object of the present invention that the compliance structure having a fluid inflated structure be used in bundle breakers in which the downstream clamp member pivots about a horizontal axis and the bundle is pivoted upwardly as in the Duecker U.S. Pat. No. 5,927,592 patent.

It is a further object of the present invention that the compliance structure have a fluid inflated structure and in which the downstream clamp pivots about a vertical axis as shown in the Fernandez U.S. Pat. No. 5,865,358 patent.

It is still another object of the present invention that the compliance structure have a fluid inflated structure and in which the downstream clamp pivots about an X-Y axis as shown in the Shill U.S. Pat. No. 6,019,267 patent.

A major feature of the present invention is a structure which can easily detect and transmit the information that the first compliance structure has touched the highest log adjacent the bundle breaking plane.

The end rigid member is lowered to its maximum extension; the next four rigid members engaging the higher remainder stack are moved to their maximum contracted position; the next four rigid members in engagement with the shorter remainder stack are slightly lower than the rigid members in contact with the higher remainder log; and the rigid member to the far left is lowered to its maximum extension.

Figure 1:
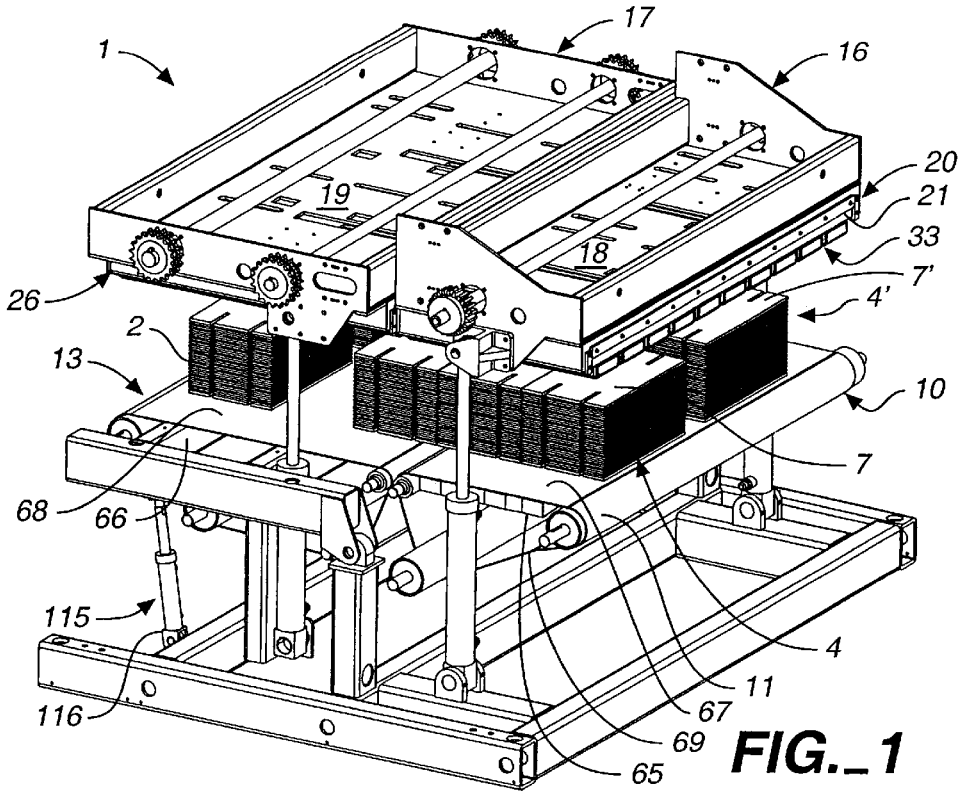
FIG. 1 is a perspective view of an example bundle breaking machine incorporating the structure of the present invention. To illustrate the operation of the machine and the inventive structure, two side by side bundles of sheet materials processed by the machine have been broken from a stack of sheets, hereafter referred to as logs, and the bundles have been transferred to a downstream portion of the machine. The remainder portion of two logs have been positioned on a precise portion of the machine ready for breaking. The machine is positioned prior to movement to a clamping position. Portions of the machine have been removed to more clearly view and understand the structure of the present invention. For illustrating the unique features of the structure of the present invention, the overall heights of the severed bundle and the remainder log on the right side of the machine as viewed from rear upstream end of the machine are greater than the heights of the severed bundle and the remainder log on the left side of the machine. This disparity in the heights of the stacks on the right and left side is continued in all of the illustrations where product is present. This height disparity is for illustrative purposes only, and in most instances, the heights of the stacks will normally be the same or substantially the same as further discussed in the specification. As previously stated, more than two logs may be severed and all of the logs and bundles could have different heights.
Figure 21:
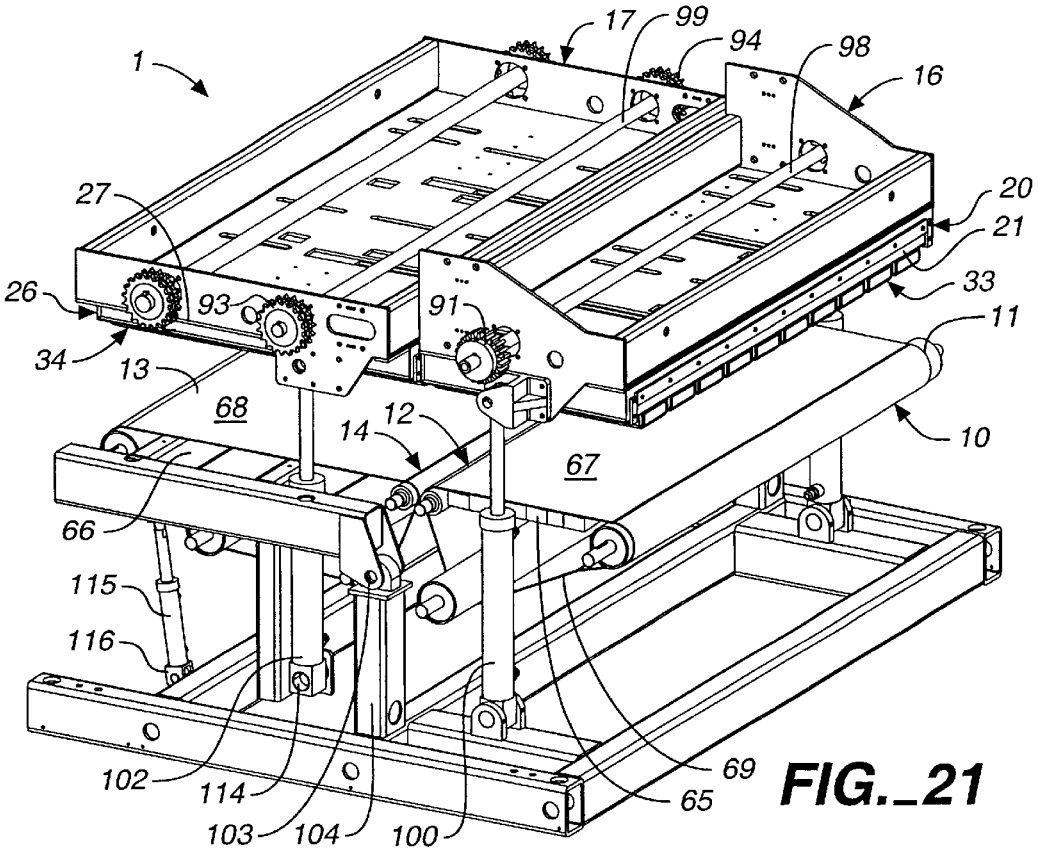

FIG. 21 is an enlarged perspective view of the machine and structure of the present invention similar to the view illustrated in FIG. 1 except that the bundles and remainder logs have been removed for purposes of clarity.

Figure 22:
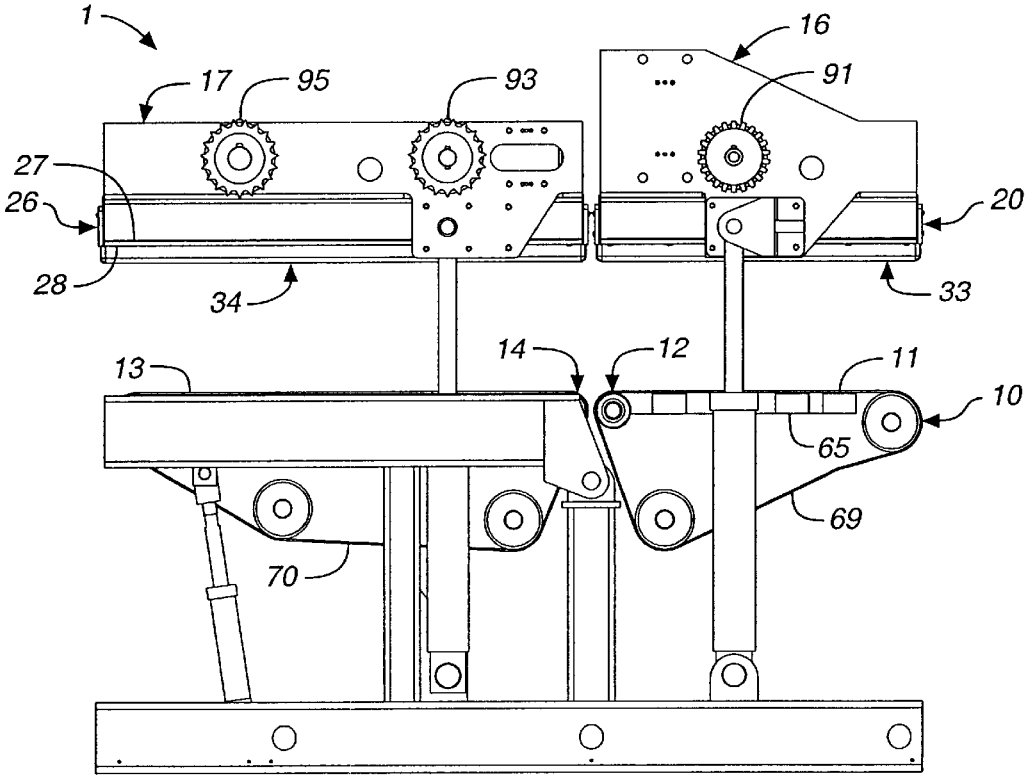

FIG. 22 is a reduced scale side view of the machine and structure of the present invention illustrated in FIG. 21. The position of all of the elements of the machine and structure of the present invention are identical to the positions of FIG. 21.

Figure 23:
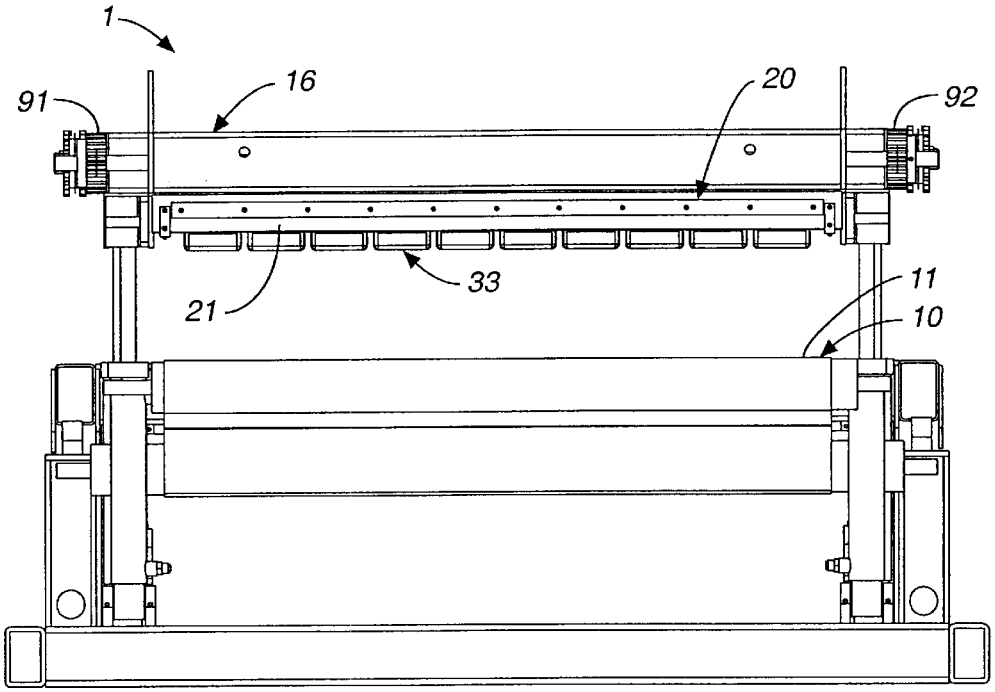

FIG. 23 is a reduced scale view of the upstream end of the machine and structure of the present invention illustrated in FIG. 21. The position of the parts of the machine and structure of the present invention is identical the position shown in FIG. 21.

Figure 24:
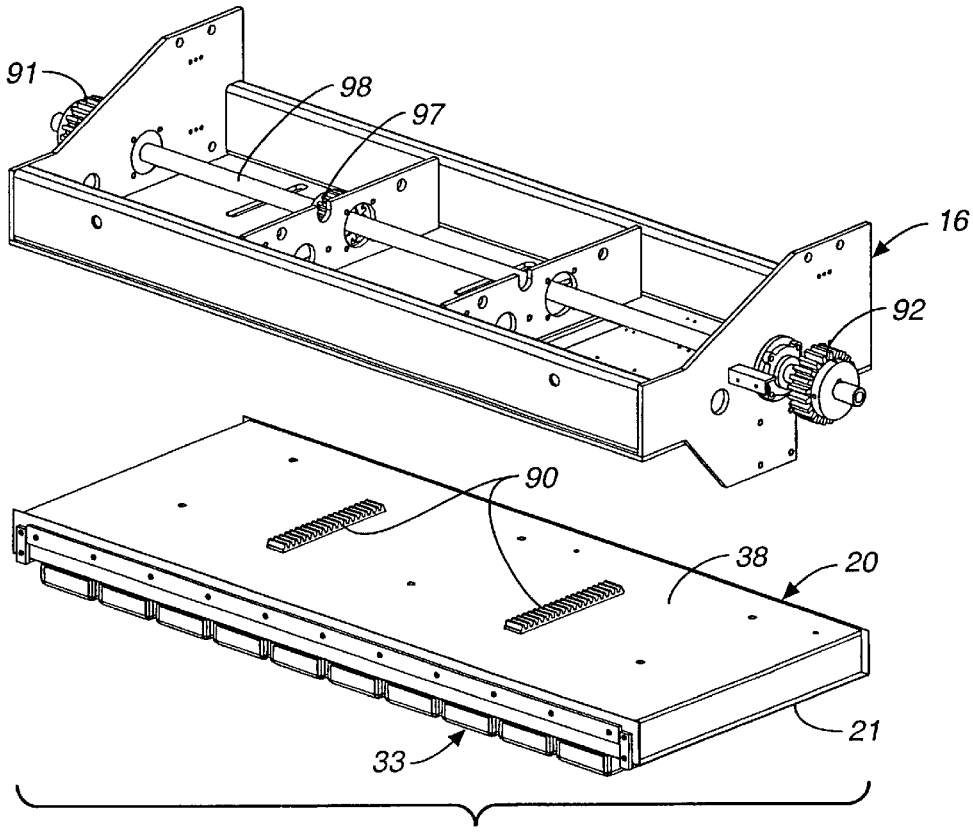

FIG. 24 is an exploded perspective view of the structure of the present invention removed from the machine illustrated in FIG. 1 and rotated clockwise about 90°. The pinion gears of the nip adjustment mechanism have been removed for clarity.

Figure 25:
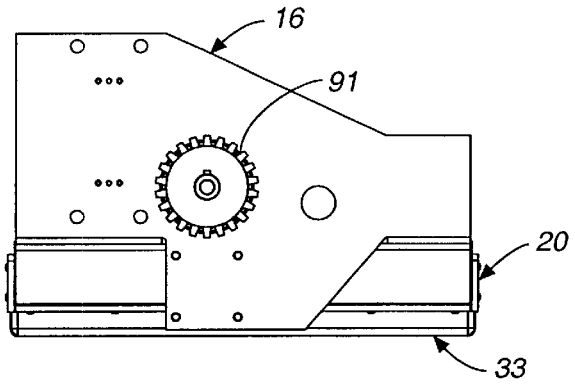

FIG. 25 is an enlarged scale side view of the reassembled parts illustrated in FIG. 24.

Figure 26:
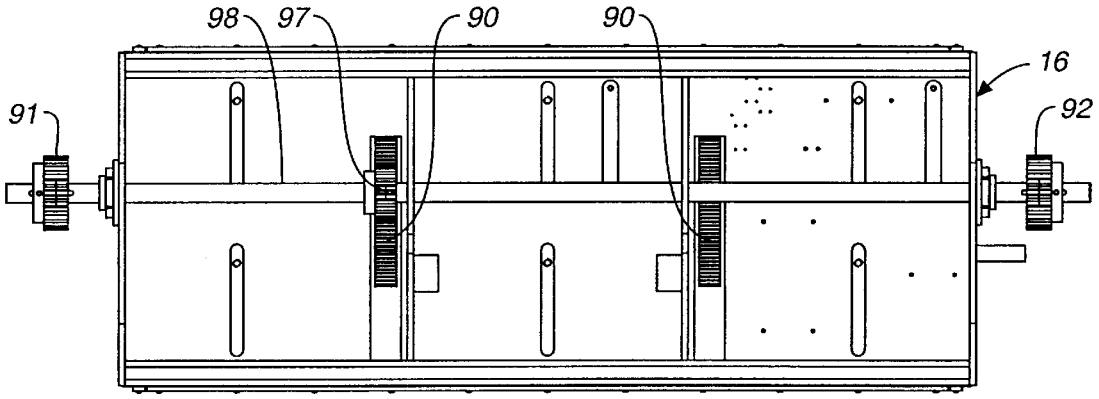

FIG. 26 is an enlarged scale top view of the assembled portion of the structure of the present invention with one of the pinion gears removed and the other pinion gear shown and engaged with one of the gear racks.

Figure 27:
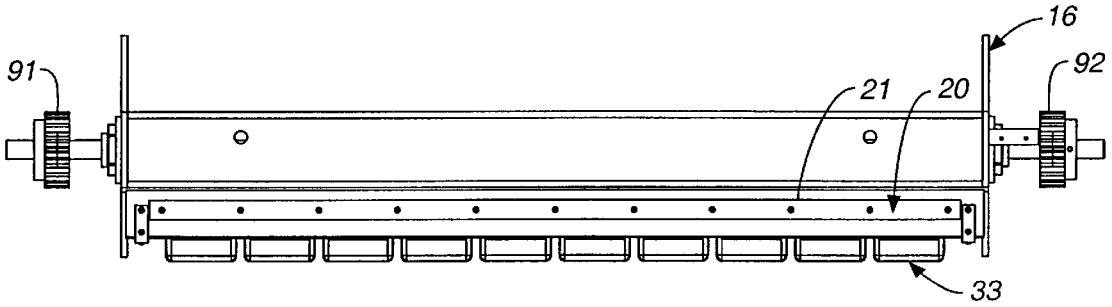

FIG. 27 is an end view of the structure of the present invention illustrated in FIG. 26.

Figure 28:
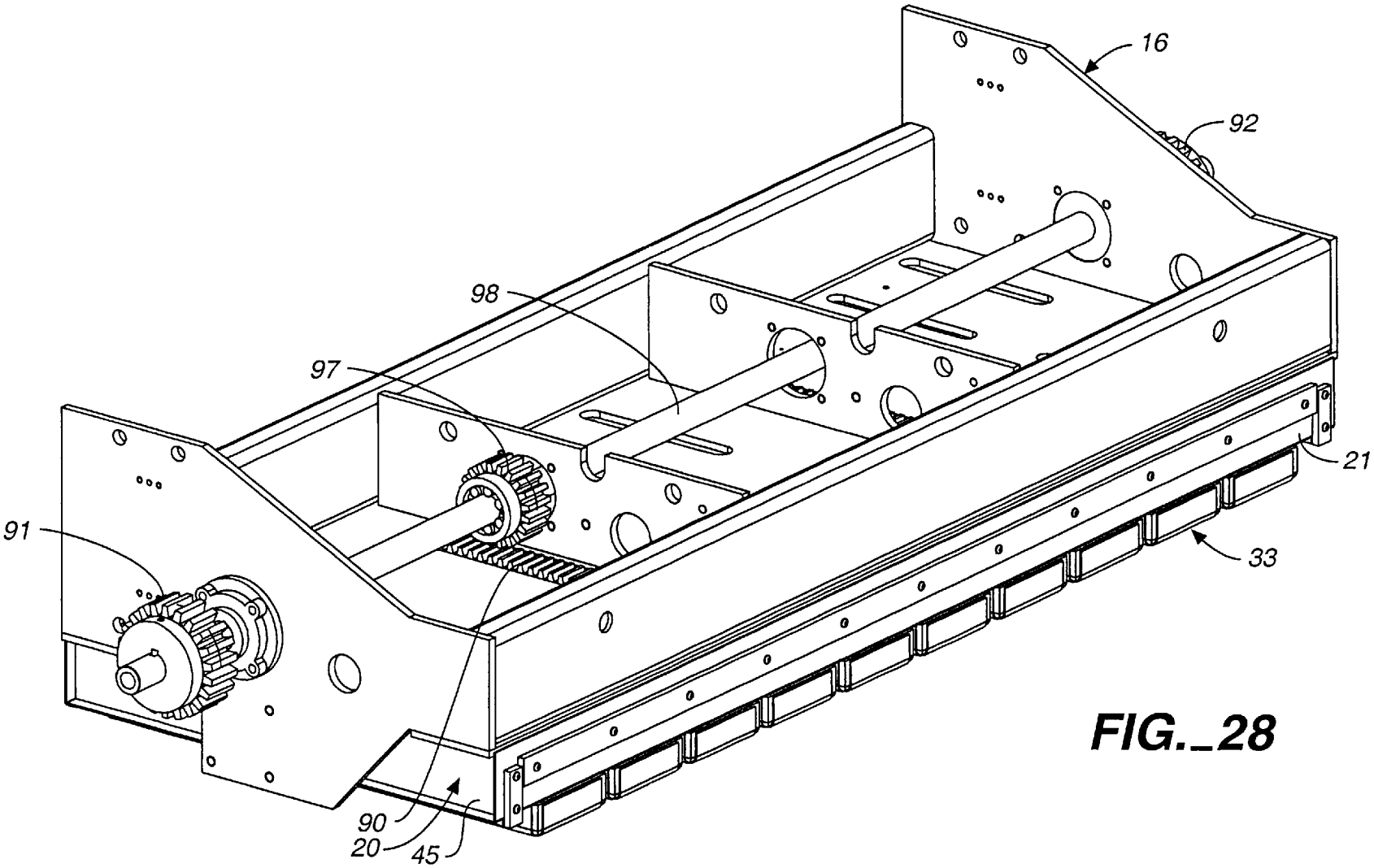

FIG. 28 is an enlarged perspective view of the assembled structure of the present invention illustrated in FIG. 24 rotated counterclock wise about 90°.

One of the pinion gears of the nip adjustment mechanism of the machine has been removed.

Figure 29:
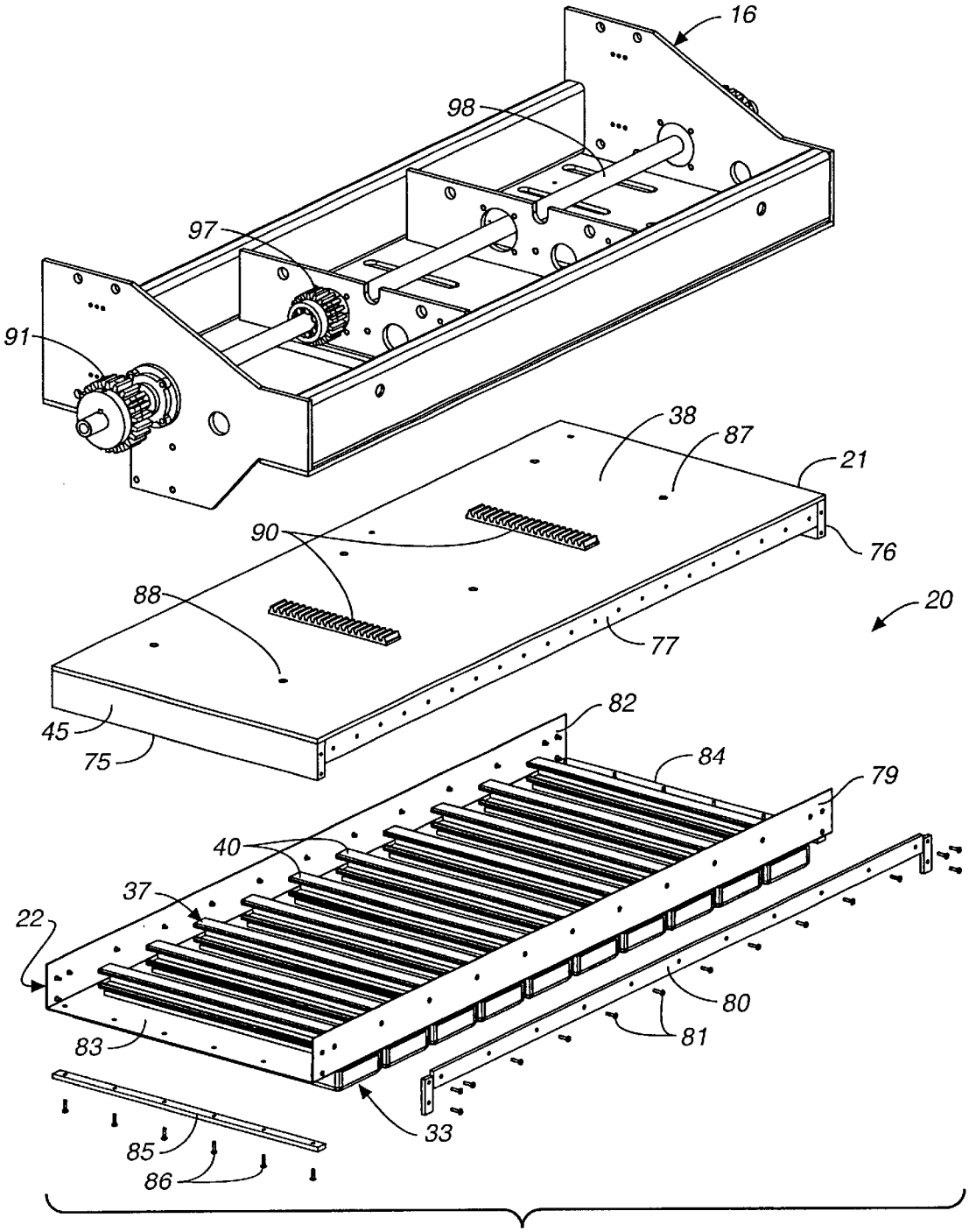

FIG. 29 is a reduced scale exploded perspective view of a portion of the machine and the structure of the present invention illustrated in FIG. 28.

Portions of the structure of the present invention have been disassembled to clarify the structure of the present invention.

Figure 30:
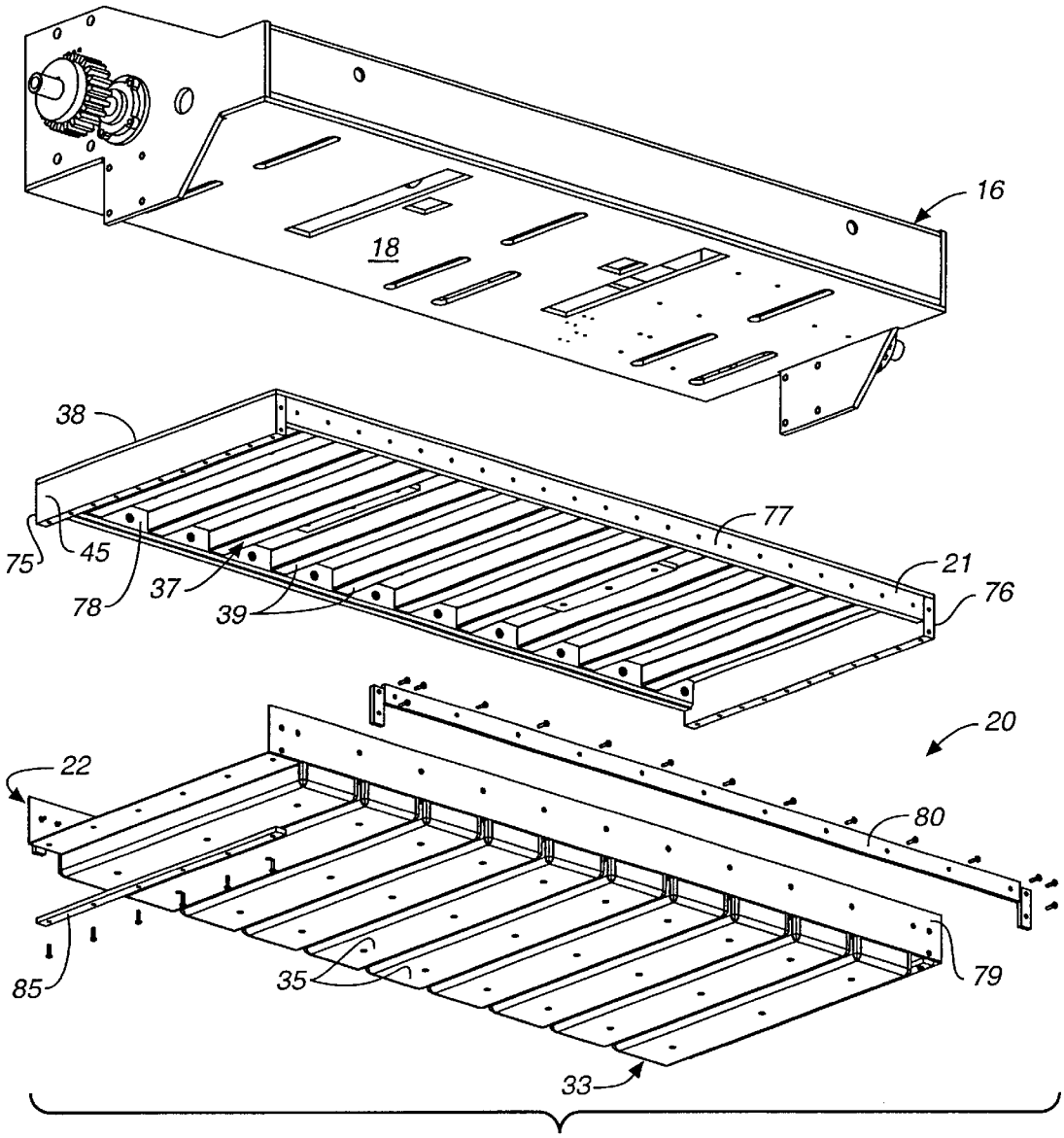

FIG. 30 is an exploded perspective view of the machine and structure of the present invention illustrated in FIG. 29, but as viewed from a point below the structure.

Figure 31:
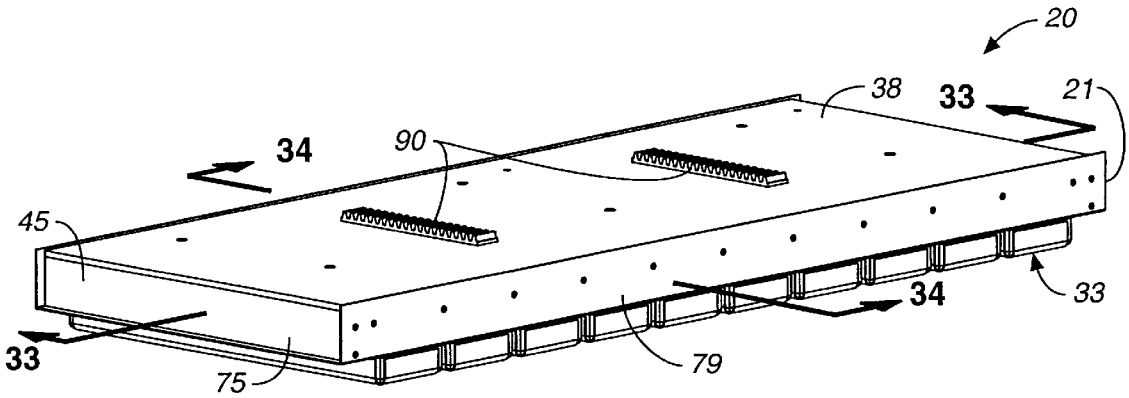

FIG. 31 is an enlarged perspective view of the assembled structure of the present invention illustrated in FIG. 29. The pinion gears of the nip adjustment mechanism shown in FIG. 29 are not shown.

Figure 32:
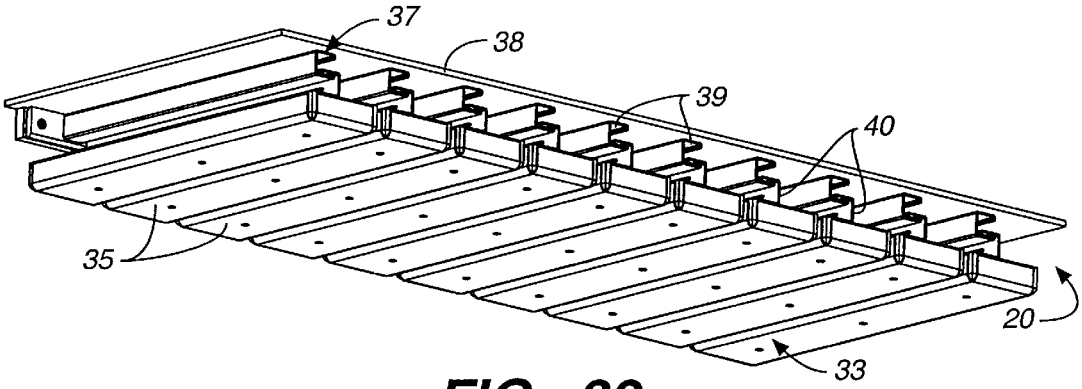

FIG. 32 is a reduced perspective view of the portions of the structure illustrated in FIG. 31 but with portions of the structure removed. The views is from a point located below the structure shown in FIG. 1.

Figure 33:
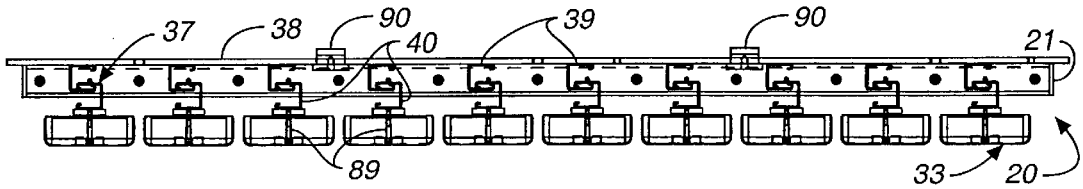

FIG. 33 is an end view of a cross section of the structure of the present invention taken along a plane through line 33 of FIG. 31 in the direction of the arrows.

Figure 34:
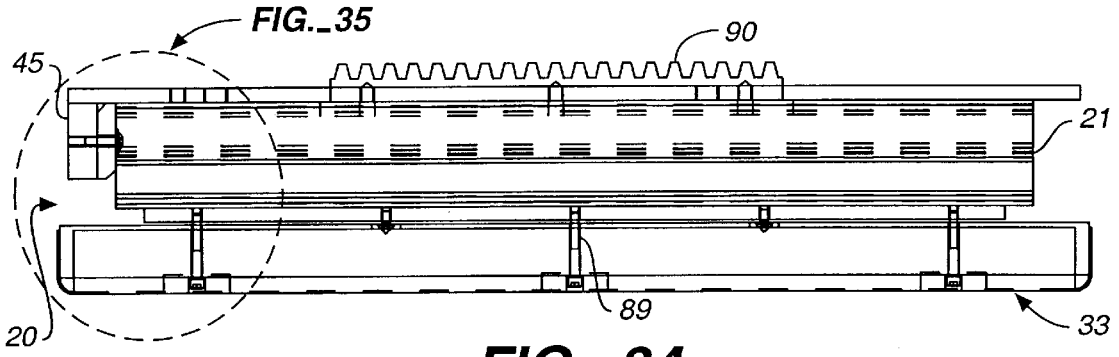

FIG. 34 is a side view of a cross sectional view taken along a plane through line 34—34 of FIG. 31 in the direction of the arrows.

Figure 35:
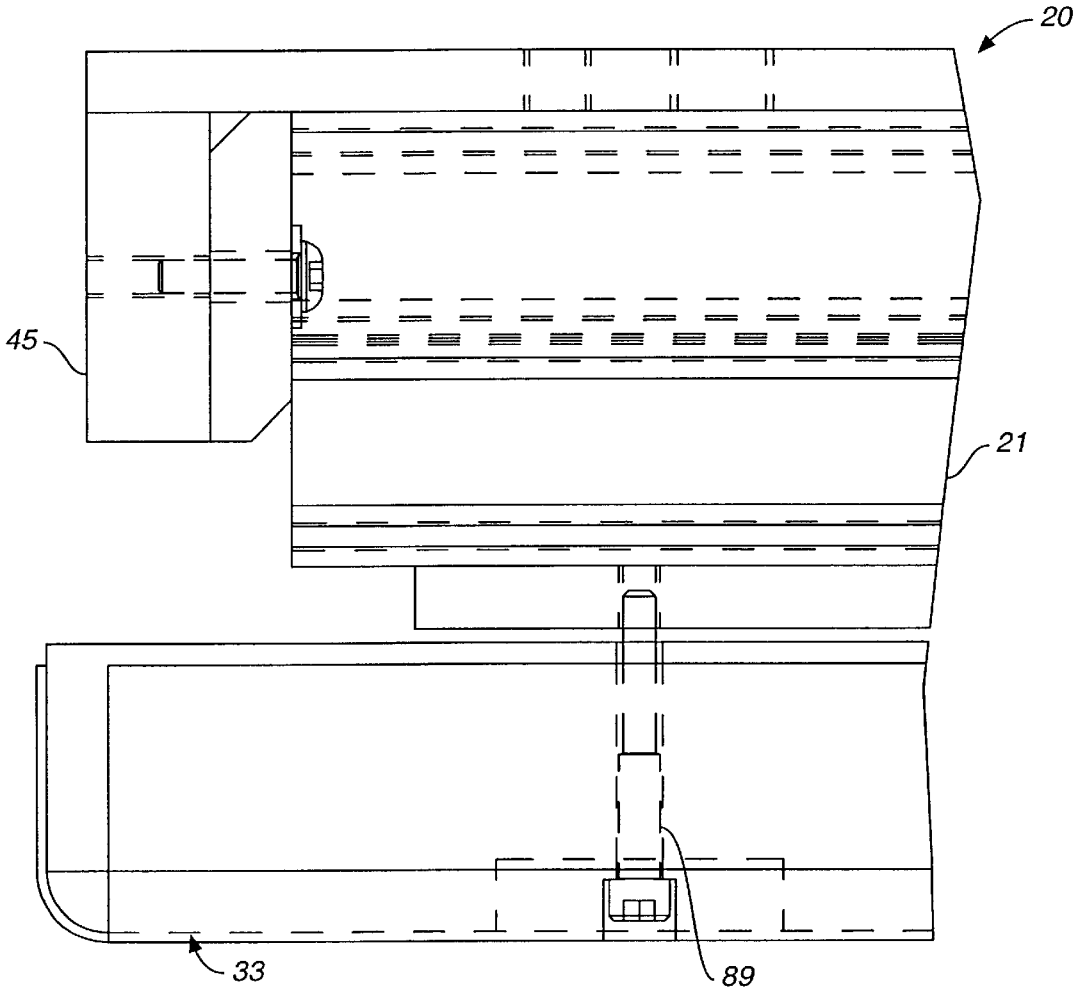

FIG. 35 is an enlarged scale detail view of a portion of the structure of the present invention taken in the vicinity of the broken line indicated by the arrow designated FIG. 35 shown in FIG. 34.

DESCRIPTION OF THE INVENTION

The present invention is an improvement in a bundle breaker 1 for separating bundles 2 from a log 4 having a generally planar top surface 5. Log 4 consists of a plurality of sheets 6 each having a generally planar top surface 7 and each sheet is formed with at least one weakened line 8. Weakened lines 8 are vertically aligned in log 4 forming a weakened plane 9 in log 4. The present invention can be used with a number of different bundle breakers; one of which is shown in the drawings for illustrative purposes. Other types of bundle breakers in which the improvement may be used are set forth in the background of the invention. Example bundle breaker 1 includes a first conveyor 10 for conveying log 4 and has an upstream end 11 for receiving log 4 and a downstream end 12.

A second conveyor 13 has an upstream end 14 positioned immediately adjacent to downstream end 12 of first conveyor 10 providing a gap therebetween defining a bundle breaking plane 15.

Bundle breaker 1 includes first clamp means 16 mounted for vertical reciprocating movement above first conveyor 10, and second clamp means 17 mounted above second conveyor 13 for vertical reciprocating movement in relation to second conveyor 13. Second conveyor 13 and second clamp means 17 are mounted for conjoint pivotal movement in relation to bundle breaking plane 15 for progressively breaking a bundle 2 from log 4 along weakened plane 9 in log 4.

Figure 2:
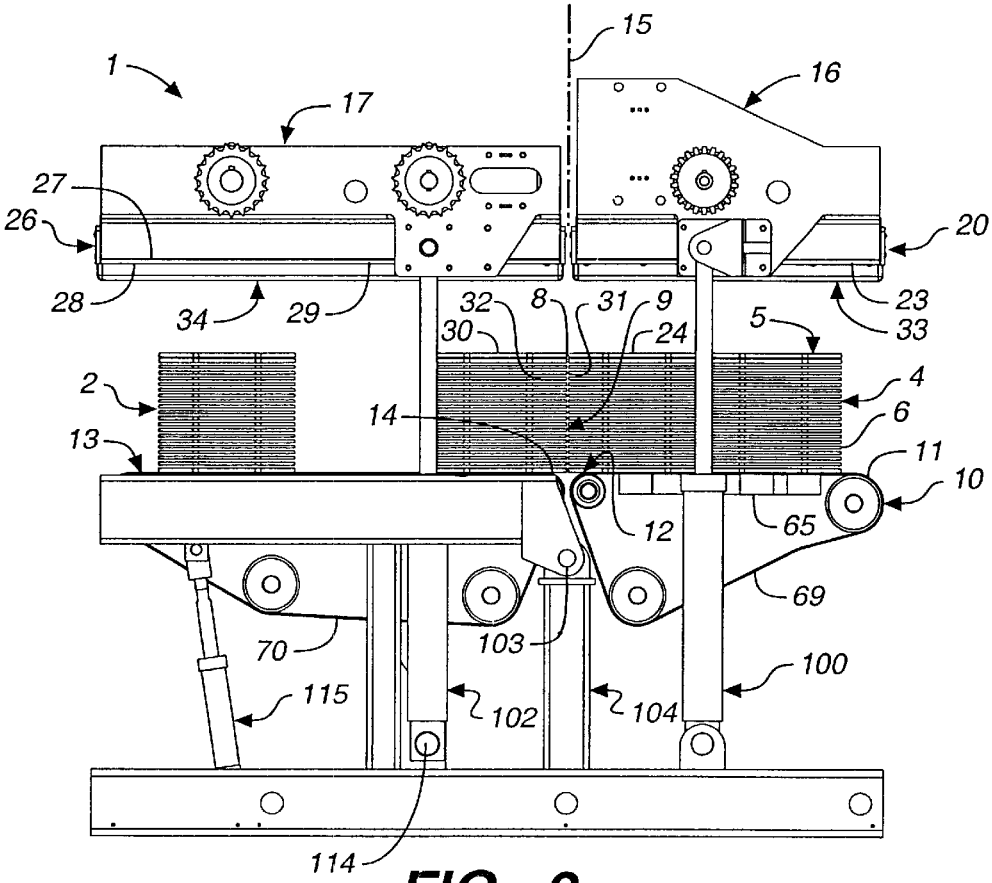
FIG. 2 is a side view on an enlarged scale of the example machine illustrated in FIG. 1. The positioning of the machine, the structure of the present invention, and the processed severed bundles and the logs awaiting separation of further bundles are the same as illustrated in FIG. 1. Careful inspection reveals that the height of the severed bundle and the height of the remainder log on the far side of the machine are greater than the severed bundle and remainder log on the near side of the machine.

Referring to FIG. 2, the improvement includes a first compliance structure 20 mounted on first clamp means 16. First compliance structure 20 includes: a first fluid pressurized structure 21 as shown in FIGS. 1, 21, and 24 having a first flexible member 22, shown in FIGS. 18, 20, 29, and 30, presenting a first engagement area 23 as shown in FIG. 2 for operative engagement with an upstream portion 24 of the generally planar top surface 5 of log 4 and on the upstream side of weakened plane 9 in log 4.

The improvement further includes: a second compliance structure 26 mounted on second clamp means 17. The second compliance structure 26 includes a second fluid pressurized structure 27 having a second flexible member 28 presenting a second engagement area 29, as shown in FIG. 2, for operative engagement with a downstream portion 30 of generally planar top surface 5 of log 4. Second fluid pressurized structure 27 is located on the downstream side of weakened plane 9 in log 4.

Preferably, first and second compliance structures 20 and 26 have a width sufficient to simultaneously engage a plurality of logs 4 and 4' in side by side relation. This enables greater production speed. The present invention can reliably process a plurality of side by side logs 4 and 4' which are of substantially equal height and can even process a plurality of side by side logs 4 and 4' when one or any number of logs have a different height.

The difference in stack height may be caused by a miscount of the sheets in one or more logs or a piece of scrap material may become lodged between one or more sheets of one or more logs.

The difference in stack height that the present machine can process depends on the preset maximum and minimum designed into the first and second compliance structures 20 and 26; and the amount of force that can be exerted on the log 4 without damaging the sheets 6 and still maintain the log 4 securely between first clamp means 16 and first conveyor 10 and second clamp means 17 and second conveyor 13 during the bundle breaking operation.

Preferably, bundle breaker 1, as illustrated in FIGS. 21 and 24, is constructed so that first and second flexible members 22 and 28 in first and second fluid pressurized structures 21 and 27 each have a width which extends substantially the width of logs 4 and 4' and are in close proximity to weakened plane 9 in log 4.

In order to achieve reliable bundle breaking with a minimum fanning of the sheets in the log as well as a minimum of fanning of the sheets in the bundle broken from the log during the bundle breaking and conveying process, the improvement for bundle breaker 1 is preferably constructed in the following manner.

First and second fluid pressurized structures 21 and 27 , as illustrated in FIG. 29 are each formed with a generally planar upper rigid wall 38 affixed to first and second clamp means 16 and 17. A depending perimeter wall 45 is affixed to and extends downwardly respectively from each generally planar upper rigid wall 38 of first and second fluid pressurized structures 21 and 27.

First and second flexible members 22 and 28 are joined to respective perimeter walls 45 in pressure sealing engagement therewith and first and second engagement areas 23 and 29, as shown in FIG. 2, of first and second flexible members 22 and 28 each present a substantially planar unbroken surface area with infinite indentation flexibility upon the application of forces to any portion of the substantially planar unbroken surface areas.

Preferably the improvement in bundle breaker 1 includes means for varying the pressure in each of the first and second fluid pressurized structures 21 and 27. This feature is particularly valuable in providing compliance ability where there are a plurality of side by side logs 4 and 4' which is discussed in greater detail below.

Figure 3:
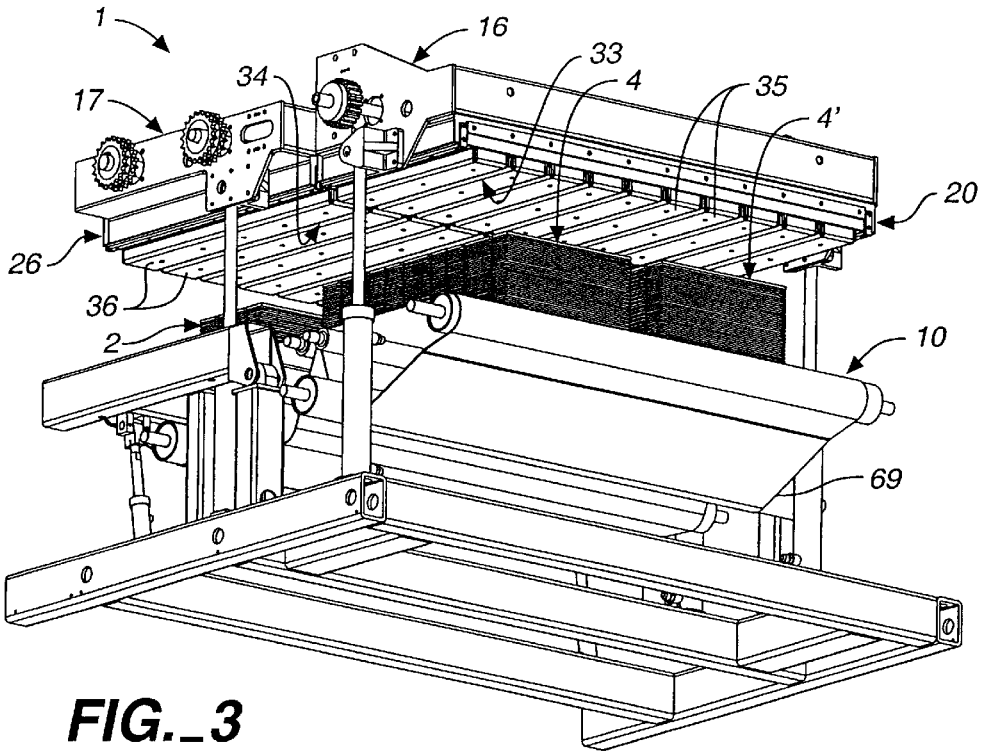
FIG. 3 is a perspective view of the same machine illustrated in FIG. 1 taken from a different view angle. The view is from a point from the upstream side and from below the machine looking toward the downstream side and up into the structure. This view more clearly shows the structure which is the subject of the present invention. The positioning of the various parts of the machine, the structure of the present invention and the placement of the severed bundles and the positioning of the remainder logs ready for severing is identical to the positionings illustrated in FIGS. 1 and 2.

A further improvement in bundle breaker 1 of the present invention includes: a plurality of first and second rigid members 33 and 34, shown for example in FIGS. 1, 2 and 3, operatively engaged by the first and second flexible members 22 and 28 and having generally flat portions 35 and 36 for engaging logs 4 and 4'. These rigid members may be preferably made of wood, metal, plastic, composites, or other relatively rigid materials.

The terms "rigid member" 33 and 34, as used in the specification and claims, is a short hand term and does not mean they are absolutely rigid. Since the rigid members are made of wood, plastic, light gauge steel or composites, they can and do bend under certain loads. In fact, rigid members 33 and 34 may be coated with rubber and high friction materials or a thin layer of rubber may be bonded to the under surface 35 to minimize slippage between the under surface 35 as shown in FIG. 30 of the rigid members 33 and 34 and the top surface 5 of log 4.

As shown in the drawings such as FIG. 3, first and second rigid members 33 and 34 extend generally in the longitudinal direction of log 4.

Another feature of the improvement in the present invention is shown incorporated in the bundle breaker 1, shown for example, in FIGS. 32 and 33 incorporated in first compliance structure 20. A first limiting means 37 limiting the vertical movement of the first and second plurality of rigid members 33 and 34 is illustrated in FIG. 29 and is discussed further below.

Figure 14:
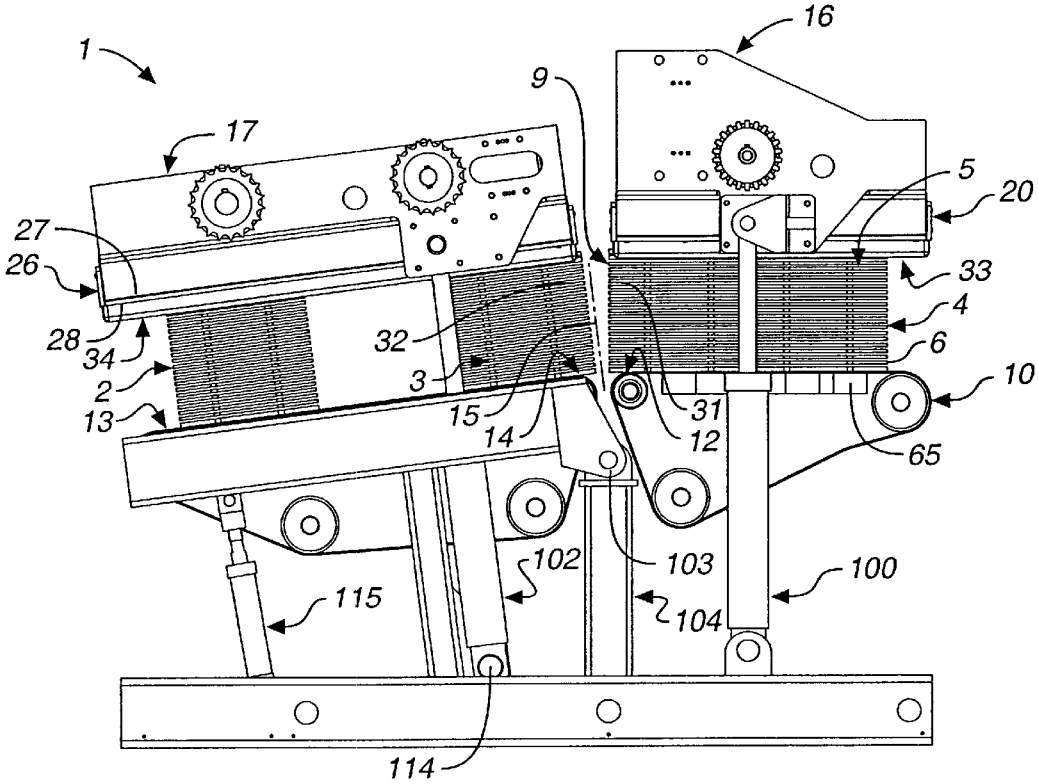
FIG. 14 is a side view of the machine and structure of the present invention shown in FIG. 13 on an enlarged scale. It may be seen that both side by side severed bundles and both side by side remainder logs have been cleanly severed respectively from one another. It also may be noted that all four of the severed bundles are now riding on the pivoted portion of the machine and that the sheet stacks remain in straight stacks without appreciable fanning of the sheets.
Figure 15:
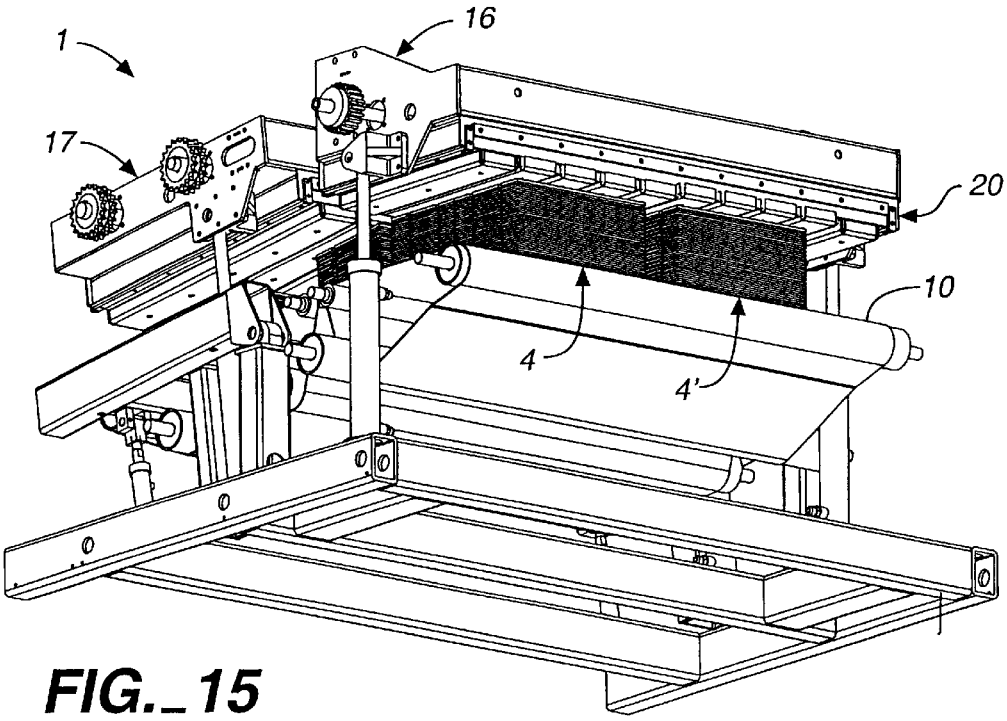
FIG. 15 is a perspective view of the machine including the structure of the present invention shown in FIG. 13 taken from a different vantage point. The positioning of the parts of the machine and structure of the present invention is the same as illustrated in FIGS. 13 and 14.
Figure 16:
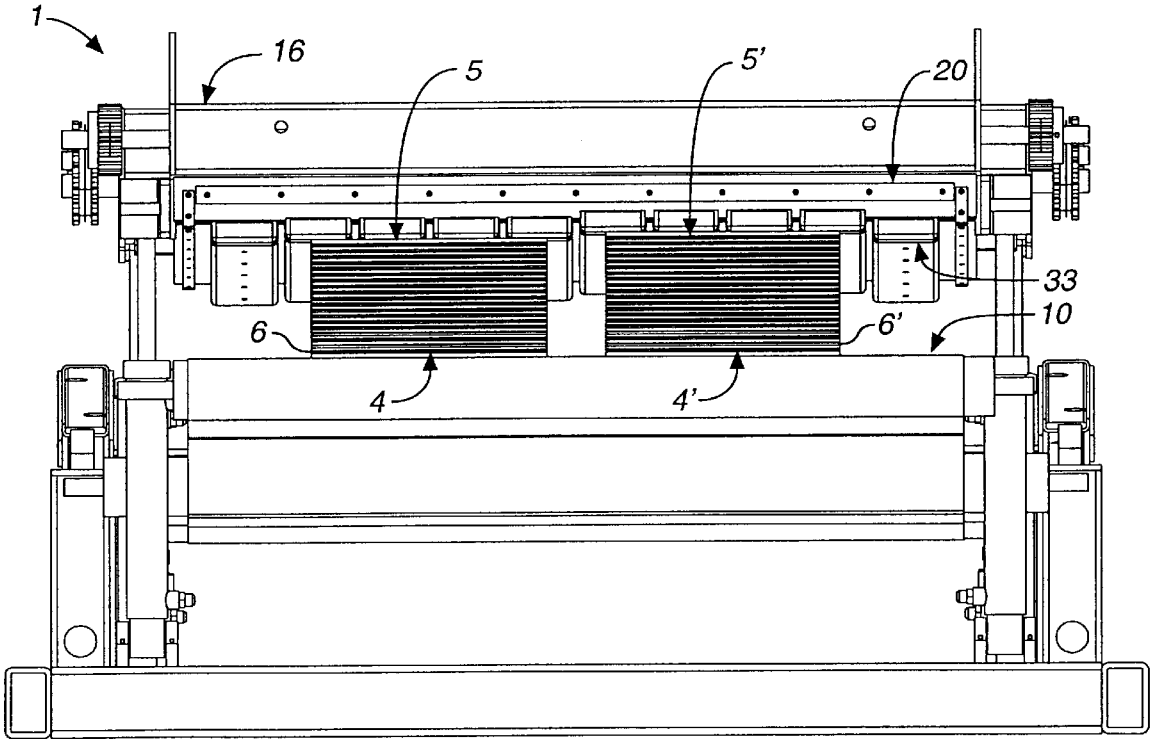
FIG. 16 is an enlarged end view taken from the upstream end of the machine illustrated in FIG. 15 looking toward the downstream end and showing the upstream ends of the remainder logs. The position of the parts of the machine, the structure of the present invention and the remainder logs is identical to the positionings in the previous drawing FIGS. 13, 14, and 15. The positioning of the rigid members with respect to the remainder logs remain the same as illustrated in FIG. 14.
Figure 17:
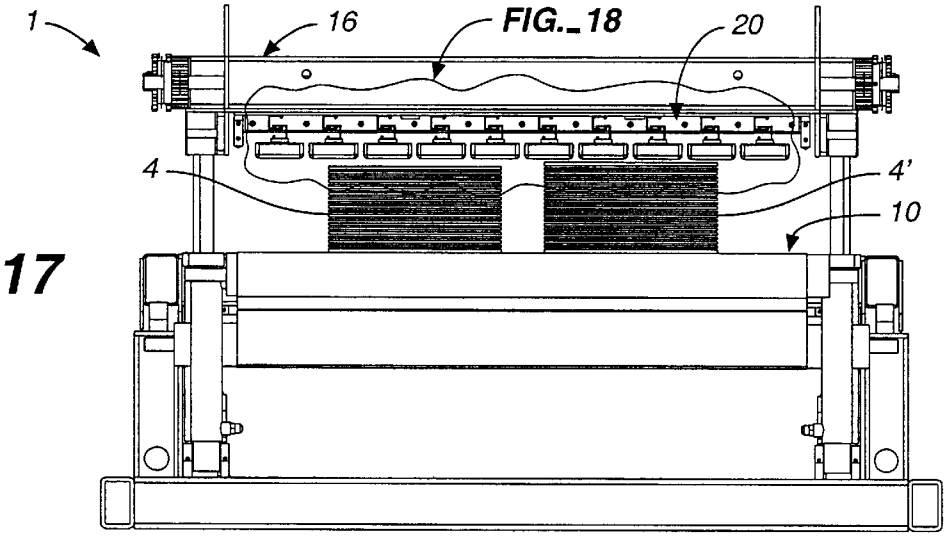
FIG. 17 is a reduced scale view of the machine and structure of the present invention illustrated in FIG. 8 except that the rigid members and their supporting structure is slightly raised above the top sheets of both remainder logs.

The weakened plane 9 of logs 4 and 4' must be rather precisely located on the bundle breaking plane 15 as shown in FIG. 14.

A squaring gate may be used to straighten the sheets 6 in log 4 before it reaches the bundle breaker 1, but the computer used to control first and second conveyors 10 and 13 can precisely stop the log 4 with the weakened plane 9 of the log 4 on the bundle breaking plane 15 as shown in FIG. 2.

Various belting materials rubberized on both sides to reduce air leakage and reinforced with various strand materials have been successfully tested. The belting selected must be relatively non stretchable, yet be compliant. As an example, applicants have found that a two ply belting with rubber on both sides manufactured by Hoffmeyer Company, Inc. of San Leandro, Calif. gives satisfactory results.

Referring to FIGS. 24–33, the improvement of the present invention for various bundle breakers such as bundle breaker 1 illustrated is further described as follows:.

First limiting means 37, previously mentioned above, includes a generally planar upper rigid wall 38 having a strength sufficient to maintain a generally planar surface during maximum clamping force.

First limiting means 37 further includes a plurality of first C-shaped members 39, (see FIG. 33), arranged in parallel separated positions parallel to rigid members 33 which are attached to planar upper rigid wall 38. First limiting means 37 also includes a plurality of second C-shaped members 40 which interlock with first C-shaped members 39; and each of the rigid members 33 are individually attached to one of the second C-shaped members 40. The purpose of this structure is to provide compliance as described below.

Second limiting means, not shown, is a part of second compliance structure 26 shown in FIG. 3, and is constructed in the same manner as first limiting means 37 which is a part of first compliance structure 20 shown in FIG. 29. Because the construction of second limiting means is identical to that of first limiting means 37, it is not repeated for purposes of brevity.

As shown in the drawings, particularly FIGS. 4, 8, 12, 16, 18, and 20, there may be a miscount in the logs 4 and 4' in which case there may be more sheets in one log than the other, or there may be a piece of scrap that has lodged between the sheets in one stack which would make it higher than the other. As shown particularly in FIG. 20, log 4' is higher than log 4.

In order to break two bundles simultaneously from logs 4 and 4', in which log 4' is higher than log 4, a minimum selected pressure must be applied to both logs to keep the stacks of sheets 6 and 6' constituting the logs 4 and 4' from shifting during the breaking step when the second clamp means 17 is pivoted in relation to the first clamp means 16. It is also important that a substantially greater pressure than this minimum selected pressure not be applied to the taller stack of corrugated board or log to prevent crushing of the sheets in the taller stack. In other words, the object of this invention is to apply the same pressure to both logs even if one log is higher than the other log.

The structure for attaining the objective of applying equal pressure is discussed below. Using the present invention, where pressure is regulated, requires a different procedure in setting up and operating the machine as follows.

Figure 4:
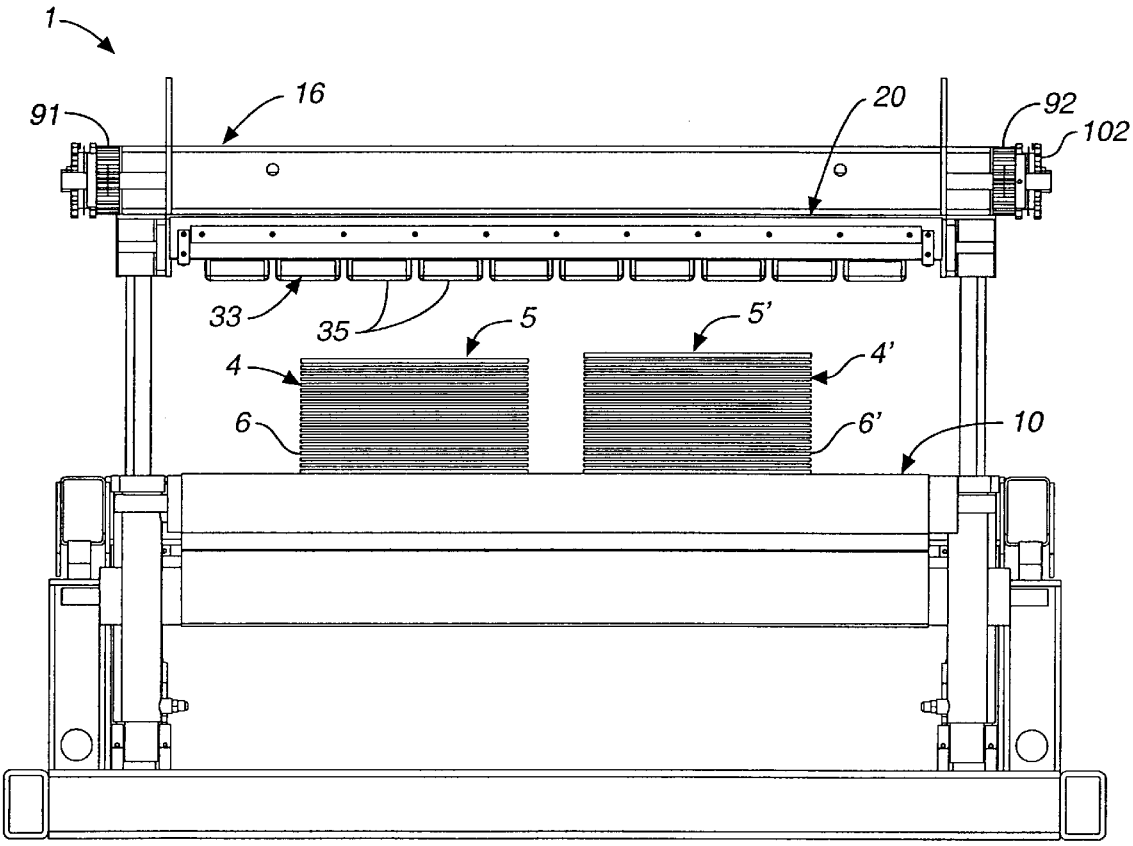
FIG. 4 is an enlarged end view taken from the upstream end of the machine illustrated in FIG. 3 looking toward the downstream end, showing the downstream ends of the remainder logs. The position of the parts of the machine, the invention and the logs is identical to the positionings in all of the previous drawing Figures. In viewing the two remainder logs, it is more readily apparent that the height of the remainder log on the right side of the machine, as viewed, is higher than the remainder log on the left side.
Figure 6:
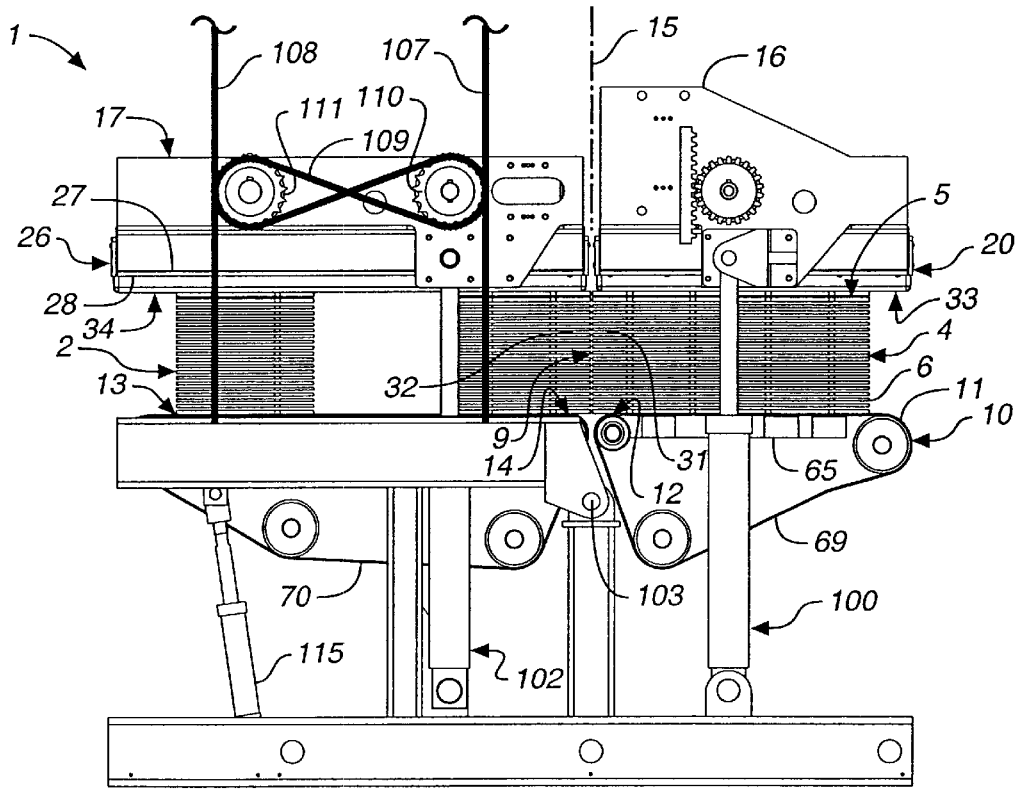
FIG. 6 is a side view on an enlarged scale of the example machine illustrated in FIG. 5. The positioning of the machine, the structure of the present invention, and the processed severed bundles and the remainder logs awaiting separation of further bundles are the same as illustrated in FIG. 5. On close inspection, it may be seen that some of the rigid members are in preset pressure touching contact with the severed bundle and the remainder log on the far side of the machine which have a greater height, but no rigid members are in contact with the severed bundle and the remainder log on the near side of the machine which has a lower height. Stabilizer chains which are part of the machines have been added in this view. These chains are part of the mechanism to keep the downstream clamping means parallel to the plane of the load carrying belts during vertical movement of the clamping means relative to the load carrying belts and also during conjoint pivoting movement of the clamping means and the load carrying belts. The heavy vertical parallel lines indicate the positioning of chains which are also part of the mechanism to maintain parallel movement of the parts of the machine just described. A rack gear has been illustrated in this view to illustrate part of the clamp raising and lowering mechanism to keep the upstream clamping means parallel in the cross machine direction. Roller tracking a vertical plane (not shown) keep the upstream clamping means parallel in the through machine direction.
Figure 7:
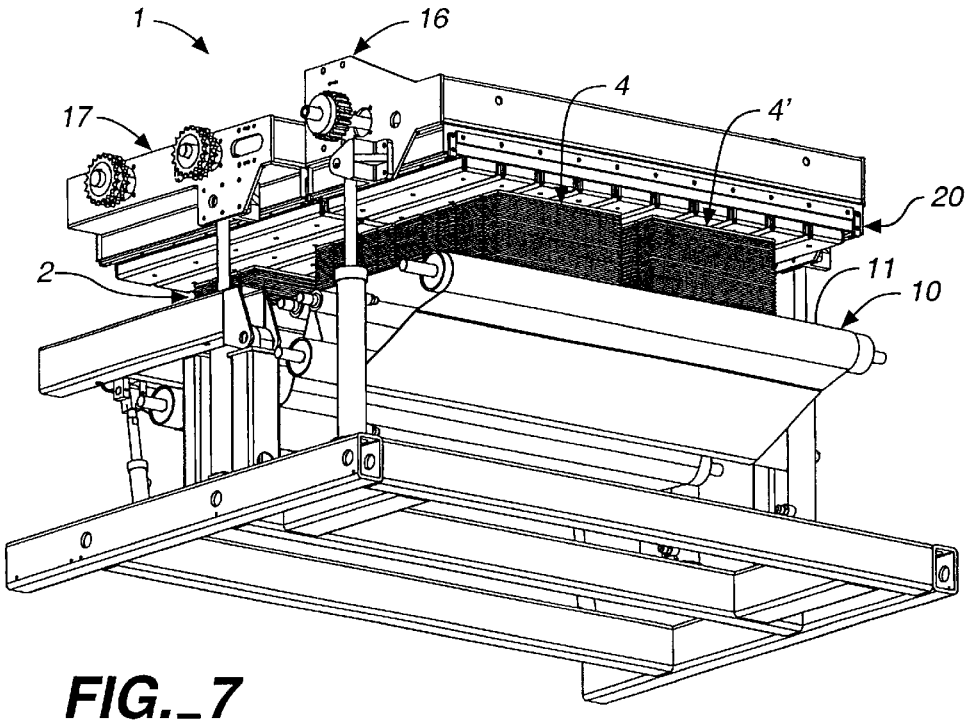
FIG. 7 is a perspective view of the machine and structure of the present invention taken from the same view angle as in FIG. 3. The positioning of the parts of the machine and structure of the present invention is the same as illustrated in FIGS. 5 and 6.

The operator programs a computer to pressurize the fluid pressurized structures 21 and 27 to about 1 to 5 PSI. Logs 4 and 4' are then moved by first conveyor 10 while the first and second clamp means 16 and 17 are in the raised position as illustrated in FIG. 4. When the weakened plane 9 of logs 4 and 4' reach the bundle breaking plane 15 as illustrated in FIG. 6, forward movement of the logs is stopped. The computer then lowers first and second clamp means 16 and 17 until the plurality of first and second rigid members 33 and 34 are just above the top surfaces 5 and 5' of logs 4 and 4', see for example FIG. 18. The computer then continues to lower, without pausing, the plurality of first and second rigid members 33 and 34 until the generally flat portions 35 and 36 (see FIGS. 3 and 18) of first and second rigid members 33 and 34 touch the top surface of the tallest log 4'.

Figure 8:
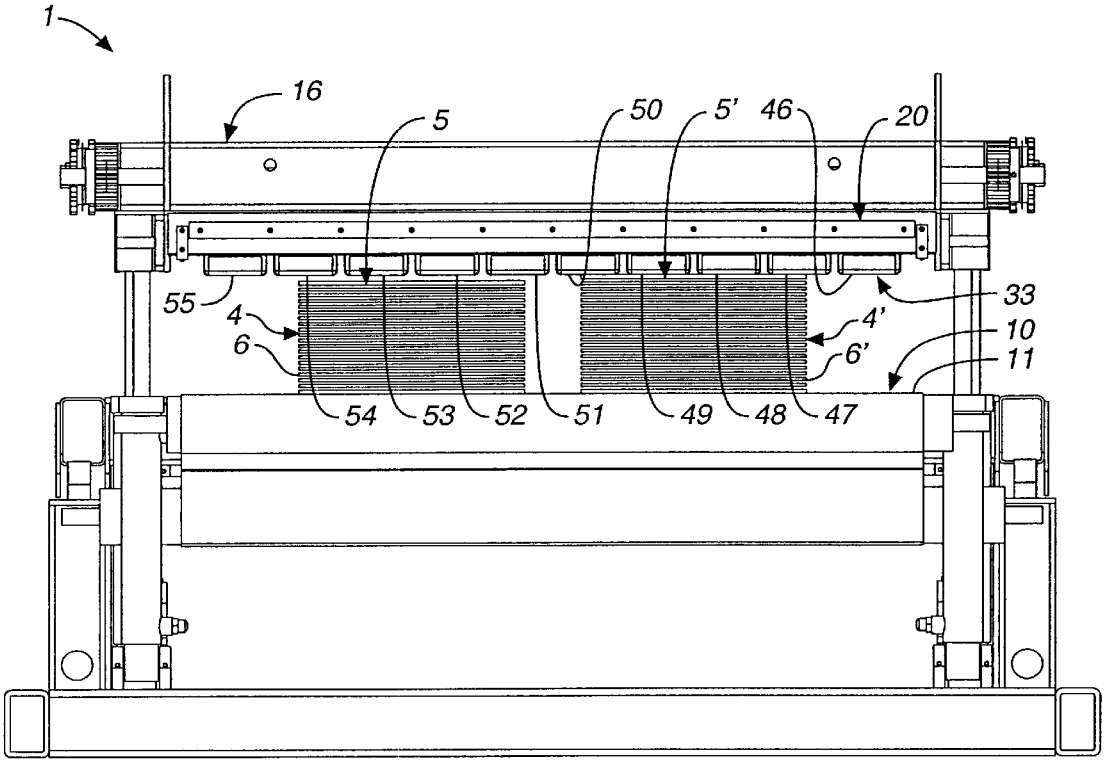
FIG. 8 is an enlarged end view taken from the upstream end of the machine illustrated in FIG. 7 looking toward the downstream and showing the upstream ends of the remainder logs. The position of the parts of the machine, the structure of the present invention and the remainder logs is identical to the positionings in the previous drawing FIGS. 5, 6 and 7. The effect of the greater height of the remainder log on the right side of the machine is now readily apparent. Some of the rigid members on the right side of the machine are now in contact with the top of the remainder log on the right side of the machine which has a greater height, while the rigid members on the left side of the machine are not yet in contact with the remainder log of less height on the left side of the machine.
Figure 9:
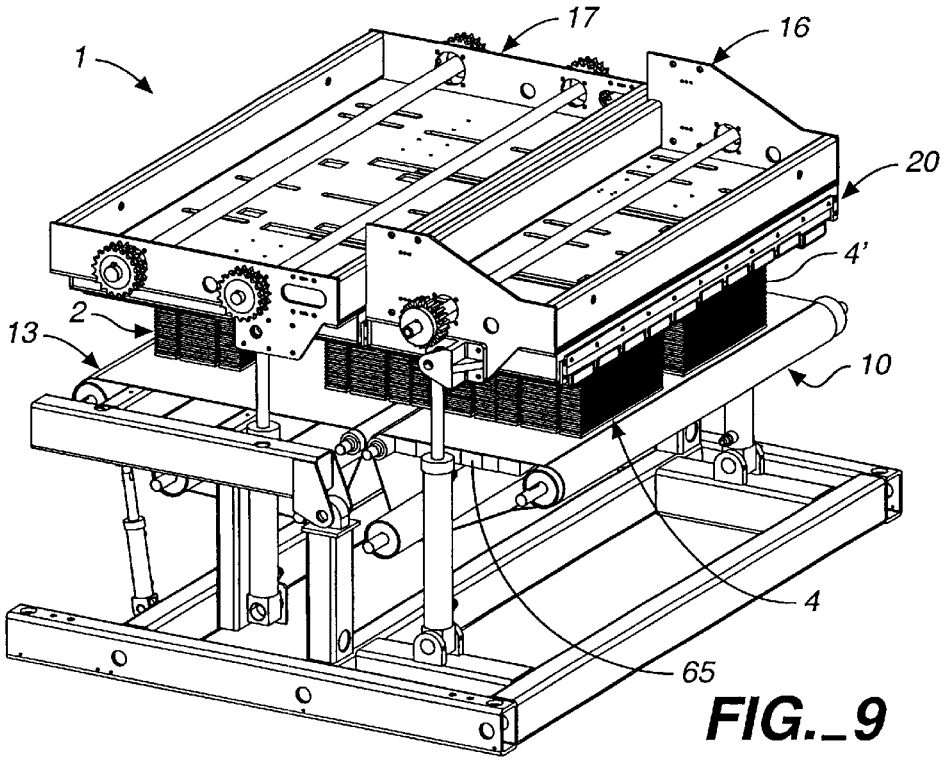
FIG. 9 is a perspective view of the machine including the structure of the present invention shown in FIG. 5 taken from the same vantage point. The parts of the machine, however, have now moved to a position of full clamping force on both severed bundles and both remainder logs.
Figure 10:
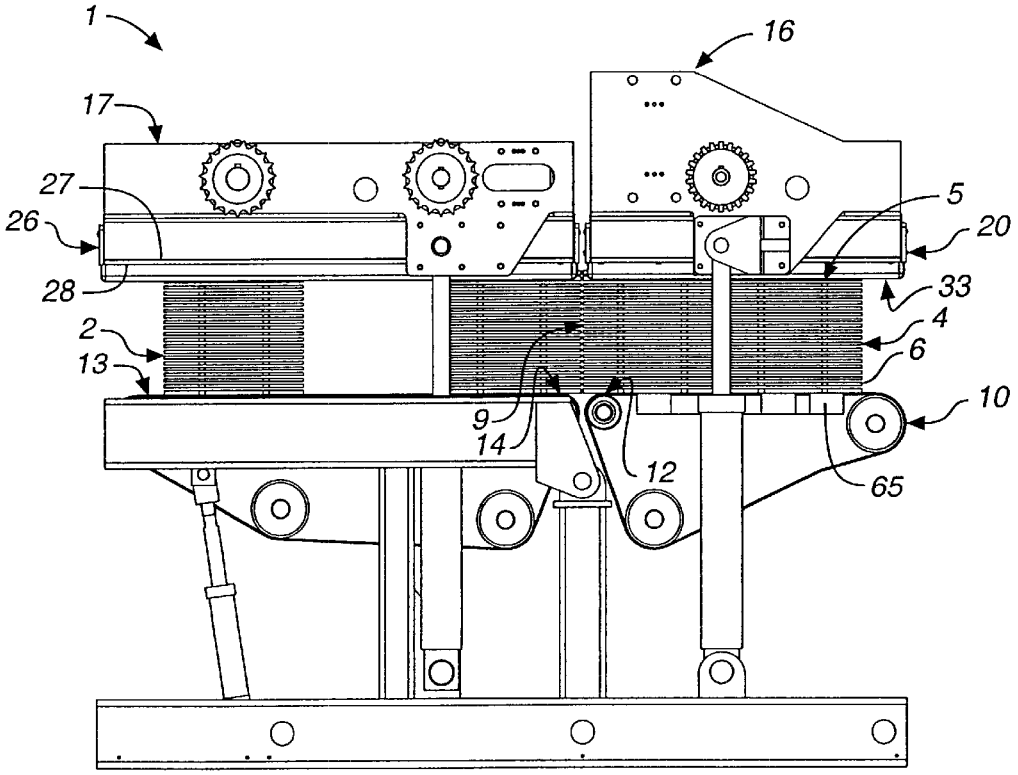
FIG. 10 is a side view of the machine and structure of the present invention shown in FIG. 9 on an enlarged scale. On close analysis it may be seen that only a slight movement has taken place in the upper portion of the machine but now all bundles and remainder logs are fully engaged by the structure which is the subject of this invention.
Figure 11:
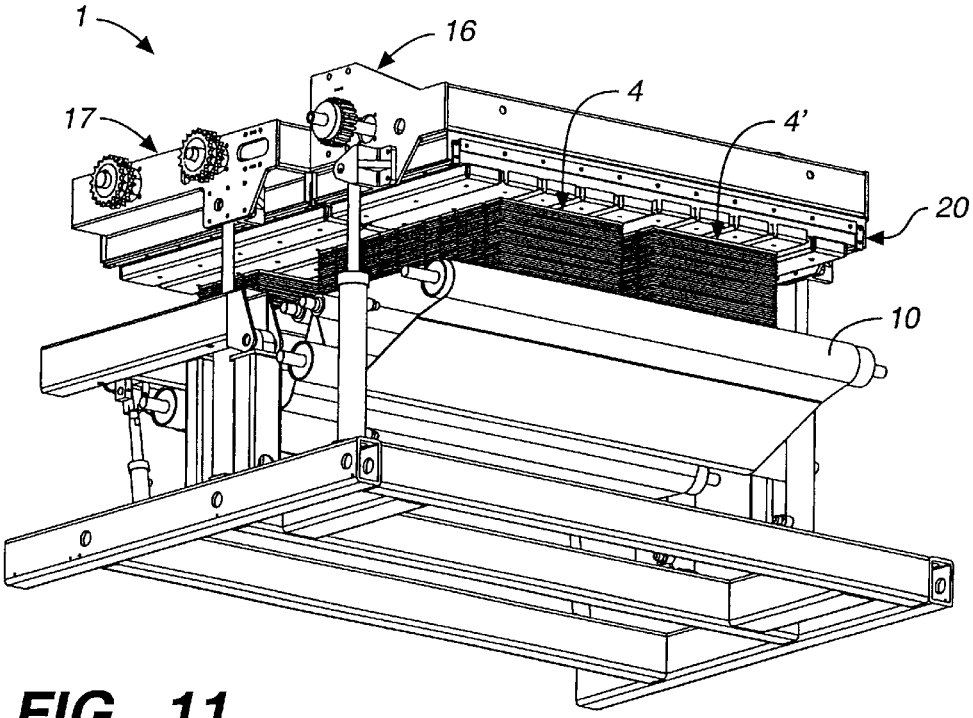
FIG. 11 is a perspective view of the machine including the structure of the present invention shown in FIG. 7 taken from the same vantage point. The positioning of the parts of the machine and structure of the present invention is the same as illustrated in FIGS. 9 and 10.

As illustrated in FIG. 8, the tallest log is log 4'. As flat portion 35 touches log 4', the computer will sense the increase in pressure in first and second fluid pressurized structures 21 and 27. The computer then continues to lower the first and second pressurized structures 21 and 27 an additional preselected incremental distance known as a "variation setting". Where the variation potential in the first and second C-shaped members 39 and 40 is ¾", the variation setting can be any distance between 0" and ¾". The variation potential may be different for different fluid pressurized structures.

For the amount of initial pressure to apply to the first and second fluid pressurized structures 21 and 27, the operator must make a judgment which is dependent on the amount of material to be severed and the characteristics of the material to be severed.

As to the variation setting, i.e., how far to lower the first and second fluid pressure structures 21 and 27 after initial contact, the operator must select a variation setting distance which will apply the least pressure on the logs 4 and 4' while still being able to achieve breaking of the logs 4 and 4' into bundles For example, the operator must take into account the width and height of a single log 4 to be severed or the width and height of a plurality of logs 4' to be severed. The operator will also have to take into account the physical characteristics of the logs and the type of nicks creating the weakened lines in the sheets.

Sheets of roof composition matter, glass, plastics, and corrugated board will require different clamping pressures and different variation settings. Sheets of corrugated board will vary in physical characteristics and hence require different clamping pressures and variation settings Corrugated board which has a high moisture content, or is made of a high percentage of recycled fiber will require different pressure and variation settings. On the other hand, corrugated board with less recycled fiber will require different pressure and variation settings. A pressure of about 1 to 5 p.s.i. and a potential variation distance of 0" to about ¾" is suitable for corrugated board.

Figure 12:
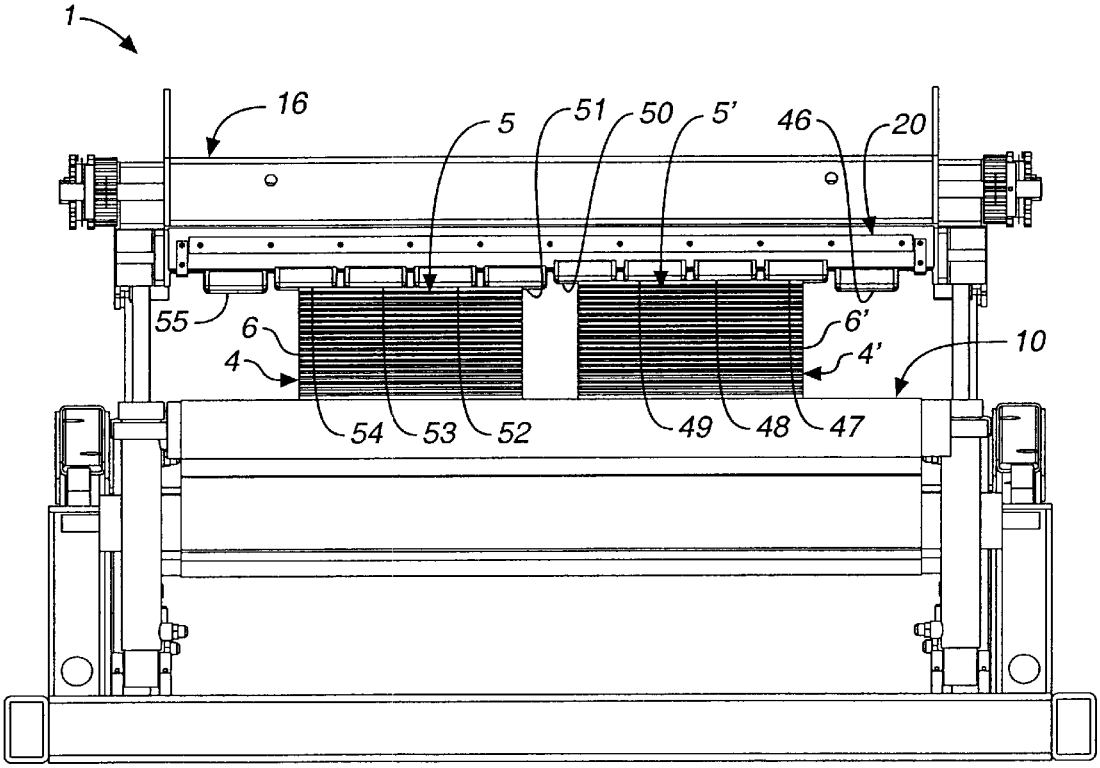
FIG. 12 is an enlarged end view taken from the upstream end of the machine illustrated in FIG. 11 looking toward the downstream end and showing the upstream ends of the remainder logs. The position of the parts of the machine, the structure of the present invention and the remainder logs is identical to the positionings in the previous drawing FIGS. 9, 10, and 11. The effect of the greater height of the remainder log on the right side of the machine is now readily apparent on the structure of the present invention. Some of the rigid members on the right side of the machine are now in contact with the top of the remainder log on the right side of the machine which has a greater height, while some of the rigid members on the left side of the machine are in contact with the remainder log of less height on the left side of the machine. The outside rigid members are in the maximum lowered position, four of the rigid members on the right side which are in contact with the remainder log on the right side are in a higher position, and four of the rigid members on the left in contact with the left remainder log are in a somewhat lower position than the position of the rigid members in contact with the right side remainder log.
Figure 13:
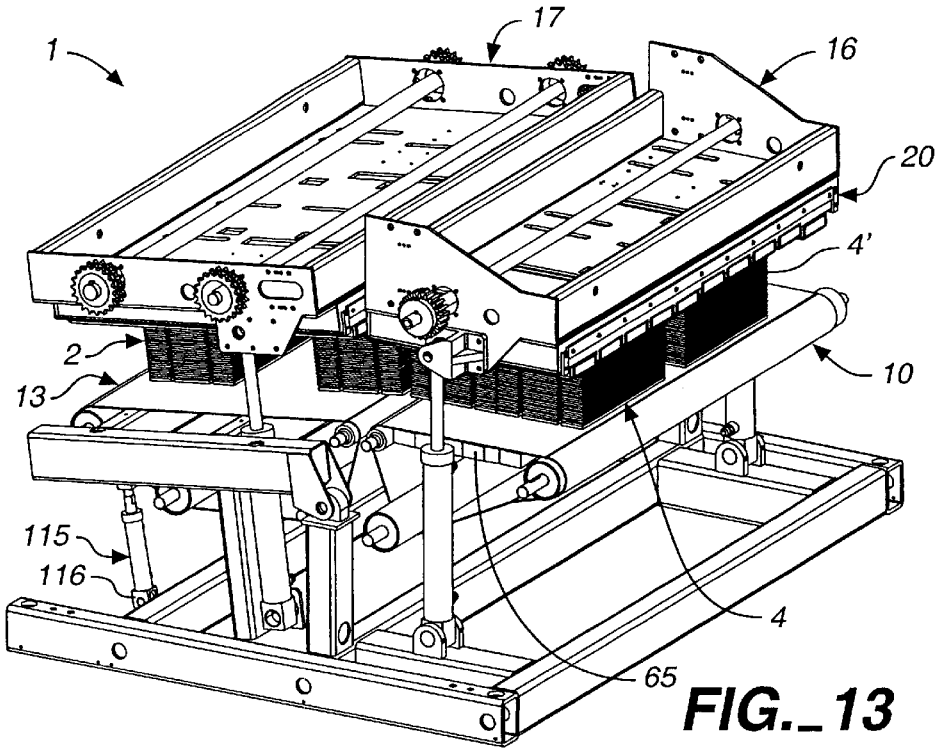
FIG. 13 is a perspective view of the machine including the structure of the present invention shown in FIG. 9 taken from the same vantage point. The parts of the machine, however, have now tilted about a horizontal axis to a position in which two side by side bundles have been severed from the two side by side logs.
Figure 20:
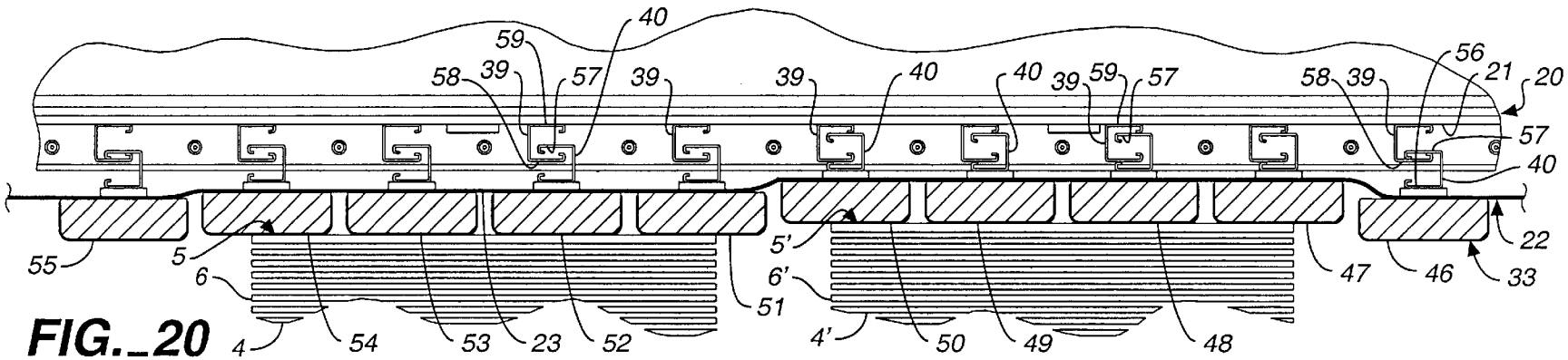
FIG. 20 is an enlarged scale view of a portion of the structure of the present invention taken in the vicinity of the arrow labeled "FIG. 20" in FIG. 19. The position of the portions of the machine and portions of the structure of the present invention is identical to the positions shown in FIG. 19.

In FIGS. 12 and 20 full clamping pressure for the particular product being severed has been applied. The logs 4 and 4' are ready to be severed and the plurality of first and second rigid members 33 and 34 assume different positions as illustrated. As an example, and as best illustrated in FIG. 20 the plurality of first rigid members 33 have been individually numbered with given numbers 46–55. Reading from right to left, rigid member 46 is not touching any part of log 4' and thus it is fully extended downwardly to its designed position. Note that upper horizontal flange 57 of second C-shaped member 40 connected to rigid member 46 is engaged with the lower horizontal flange 58 of first C-shaped member 39.

Rigid members 47–50 are either partially or fully engaging top surface 5' of log 4' and clamping pressure is being applied. Note that all of the rigid members 47–50 are at their maximum height and are restrained by upper horizontal flange 57 of second C-shaped member 40 engaging upper horizontal flange 59 of first C-shaped member 39.

Typically, it is not recommended that maximum variation setting be applied which would cause the horizontal flanges 57 of second C-shaped members 40 to touch upper horizontal flanges 59 of first C-shaped member 39. Further clamping travel could cause some of the plurality of rigid members 33 and 34 to exert unequal pressure on logs 4 and 4'.

Referring to FIG. 20, rigid members 51–54 are either partially or fully in engagement with top surface 5 of log 4 which has a lower elevation than the top surface 5' of log 4'. Provided upper flanges 57 are not touching upper flanges 59, the pressure in first fluid pressurized structure 21 is even throughout and the pressure exerted by each of the rigid members 47–54 on logs 4 and 4' will be the same. Note that rigid members 51–54 on log 4 are lower because log 4 is not as high as log 4'. Rigid members 51–54 are not at either their maximum or minimum range of movement. Note that top horizontal flange 57 of second C-shaped member 40 is not in touching contact with either the lower horizontal flange 58 of first C-shaped flange 39 or the top horizontal flange 59 of first C-shaped member 39.

Rigid member 55 is not in touching contact with any log and is therefor extended to its maximum. The relative positioning of the first and second C-shaped members 39 and 40 above rigid member 55 is identical to the positioning of the C-shaped members 39 and 40 above rigid member 46.

Prior Art Distinguished

Some prior art bundle breakers elevate the log above the conveyors carrying the log during the pivoting of the clamps to sever a bundle from the logs. See Fernandez, U.S. Pat. No. 5,865,358 and Pallmac bundle breaker, not patented, but shown in undated sales brochure in the Information Disclosure Statement of this application. Both Fernandez and Pallmac provided a plurality of laterally spaced narrow width belts in their log support conveyors and used lifting blocks between the narrow belts to lift the logs during the bundle severing operation.

In contrast, Applicants provide first and second single, wide, continuous, belts 69 and 70 in both their first and second conveyors 10 and 13 as shown in FIGS. 1–23 and do not lift the logs above either the first or second conveyors 10 and 13 at any time. Thus logs 4 and 4', and the bundles severed from them, rest on single, wide, belt portions, 67 and 68 of first and second single, wide, continuous, belts 69 and 70 at all times while they are on the bundle breaker machine 1.

Unlike the Pallmac and Fernandez bundle breakers which only support about 50% of the bottom surface area of logs and bundles, the logs and bundles of the present invention are 98 to 100% supported on the bottom side of the logs, and about 80% of the top surface of logs 4 and 4' are engaged by rigid members 33 and 34.

As best shown in FIGS. 1, 2, 5, 6, 21 and 22, first and second horizontal support members 65 and 66 providing a continuous support surface are positioned below first and second belts 69 and 70, support first and second single, wide, belt, portions, 67 and 68. Note that first and second horizontal support members 65 and 66 are present in all of the machines of the present invention, they have been removed from some of the FIG. of the drawing to more clearly show the operation of the machine.

Pressurized Structure

First and second fluid pressurized structures 21 and 27 which are respectively parts of first and second compliance structures 20 and 26 generally shown in FIGS. 1, 2, 21, and 22 are more specifically illustrated in FIGS. 1, 20, and 24–35.

Figure 18:
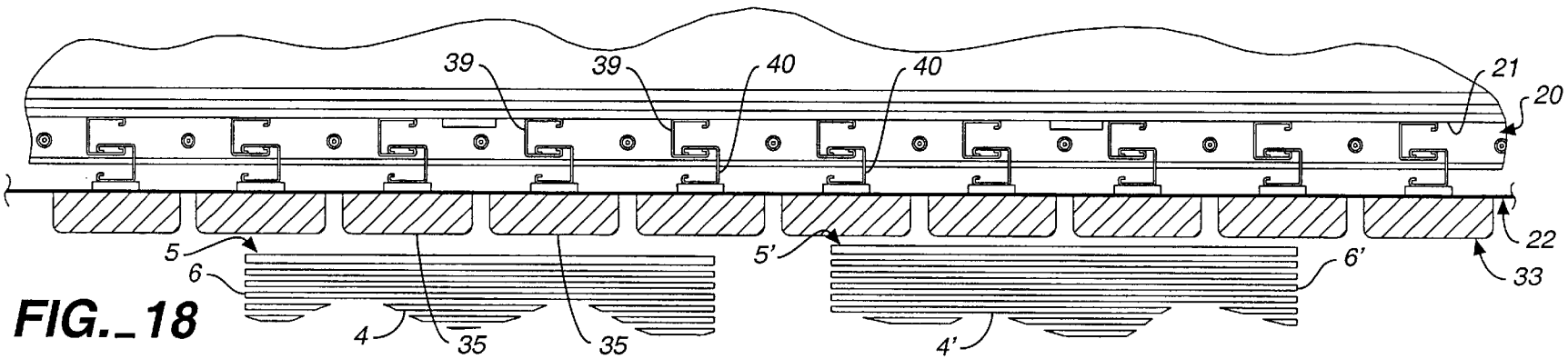
FIG. 18 is an enlarged scale view of a portion of the structure of the present invention taken in the vicinity of the arrow labeled "FIG. 18" in FIG. 17. A portion of the flexible member of the structure of the present invention is clearly shown as well as the structure for limiting the maximum extension and contraction of the stringer members as well as the range of side to side movement.
Figure 19:
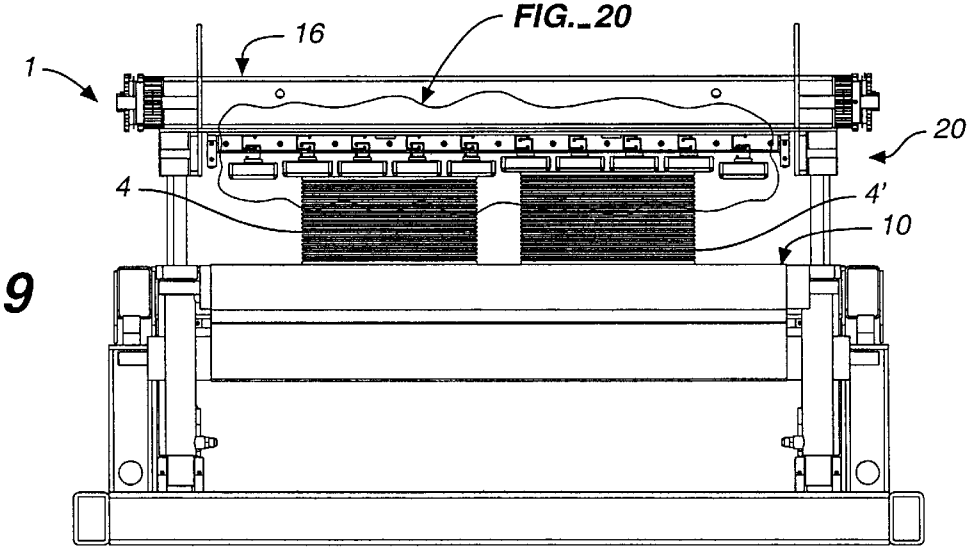
FIG. 19 is a reduced scale view of the machine and structure of the present invention similar to the view illustrated in FIG. 17 except that the structure of the present invention has been lowered to firmly contact the remainder logs.

Referring specifically to FIGS. 18 and 20, the first flexible member 22 is generally shown interposed between the plurality of first rigid members 33 and the plurality of second C-shaped members 40. First flexible member 22, while compliant is relatively non stretchable. First flexible member 22 as previously stated is made of belting material which is rubber coated on both sides to maximize sealability and fluid retention such as air and is reinforced with nylon or polyester or steel wire reinforcing for durability and stretch resistance.

Referring to FIG. 29, first fluid pressurized structure 21 is formed with a generally planar upper rigid wall 38 to which a depending perimeter wall 45 is attached. Perimeter wall 45 is made up of first rigid side walls 75 and 76 and first and second rigid end walls 77 and 78. First flexible member 22 is folded so that first end portion 79 extends upwardly as shown in FIG. 29 and may be sealably affixed to first rigid side wall 77 by bolting an end attachment plate 80 to first rigid end wall 77 by attachment bolts 81. Second end portion 82 of first flexible member 22 is attached to second end wall 78 of first flexible member 22 in an identical manner.

First side extension 83 of first flexible member 22 is sealably attached to the bottom edge of first side wall 75 by side attachment plate 85 with attachment bolts 86. Second side extension 84 of first flexible member 22 is sealably attached to second side wall 76 in the same manner.

Figure 5:
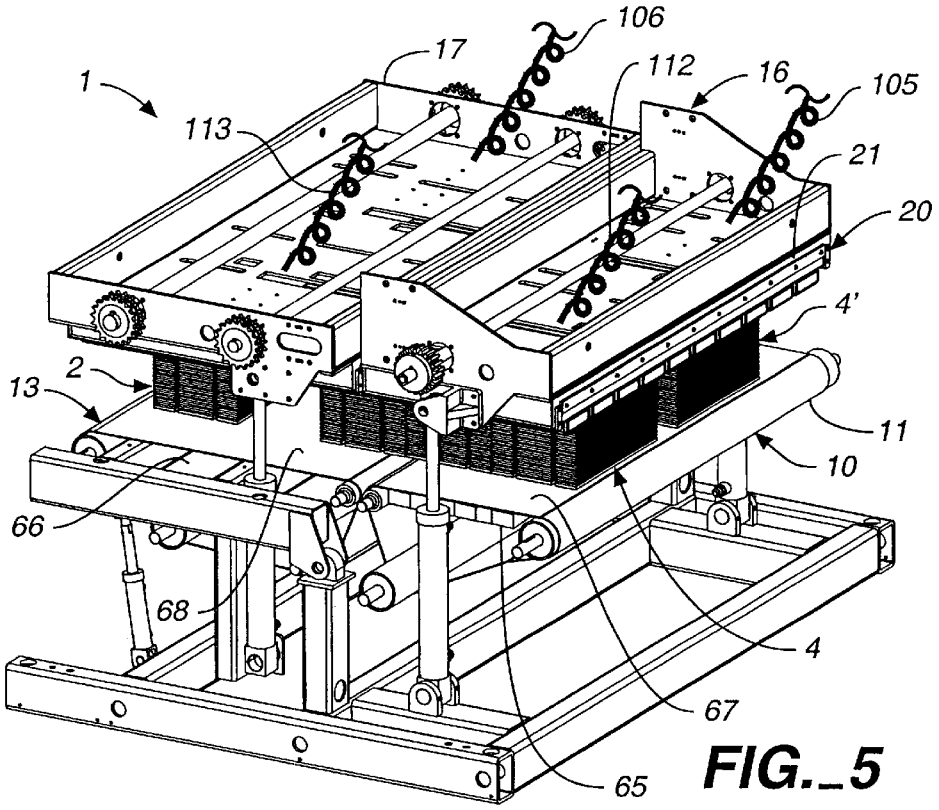
FIG. 5 is a perspective view of the same machine and structure of the present invention shown in FIG. 1 taken from the same view angle. The rigid members of the machine have been moved into initial, preset pressure, touch engagement with the severed bundle having a greater height and the remainder log having a greater height. Portions of air hoses which are also part of the structure of the present invention have been illustrated in this Figures for further clarification of the structure of the present invention.

Fluid pressure is increased or decreased through fluid pressure lines 105 and 106 shown in FIG. 5 connected to fluid port 87 shown in FIG. 29, and pressure is read by the computer (not shown) connected by fluid lines 112 and 113 shown in FIG. 5 connected to fluid ports 88 illustrated in FIG. 29.

Height Detection

One of the major features of the present invention is that the log having the greatest height can be determined by sensing the difference in air pressure and the variation setting can then be made. Means for transmitting a difference in air pressure in first and second fluid pressurized structures 21 and 27 can be incorporated in the structure. As illustrated in FIG. 5, air lines 112 and 113 are connected to first and second fluid pressurized structures 21 and 27 and the change in air pressure is transmitted to a computer means not shown.

Specifically, as shown in FIG. 8 when the first rigid member of the plurality of first rigid members 33 first contacts the top of the highest log 4', the rigid member presses against first flexible member 22 of first fluid pressurized structure 21. Air line 112 connected to first fluid pressurized structure 21 detects the incremental increase in air pressure and sends this signal to a computer not shown. The computer then automatically adds the preselected variation setting and lowers the first clamp means 16 and first compliance structure 20 the preselected distance onto logs 4 and 4'.

Construction Details

As illustrated in FIGS. 2, 33, 34 and 35, first and second rigid members 33 and 34 are attached by bolts 89 to C-shaped members 40 in a manner to prevent leakage of pressure from first and second fluid pressure structures 21 and 27.

Second fluid pressure structure 27 attached to second compliance structure 26 is constructed in a similar manner and is not set forth in this application for purposes of brevity. Additionally, first and second C-shaped members 39 and 40 for limiting the maximum and minimum extension are similar in construction and operation as used in second fluid pressure structure 27 in second compliance structure 26.

Nip Adjustment

As stated above, in most cases, it is desirable to position the end edges of the first and second rigid members 33 and 34 of first and second compliance structures 20 and 26 as close as possible to the bundle breaking plane 15. In some cases, however, it is necessary to move the end edges of the rigid members 33 and 34 closest to the bundle breaking plane 15 , away from the bundle breaking plane 15 if, e.g., corrugated board is being severed and there are cutouts close to the weakened line 8 of each of the sheets or the weakened line 8 itself is not a straight line. Other bundle breakers on the market are able to adjust the distance of their clamps to the bundle breaking line, but applicant's novel system makes this design feature a relatively easy design feature to build into the machine. Further, resetting of the nip adjustments may be quickly and easily accomplished. This is sometimes called "nip adjustment".

The improvement in a bundle breaker 1 of the present invention incorporating nip adjustment consists of providing a generally planar upper rigid wall 38 in each of the first and second fluid pressurized structures 21 and 27 and which are slidably affixed to respective first and second clamp means 16 and 17 for movement parallel to the direction of travel of the logs 4.

Gear engagement means , which in this case may be a pair of gear racks 90 are mounted respectively on first and second fluid pressure structures 21 and 27, and specifically on generally planar upper rigid wall 38 as illustrated in FIGS. 26, 28, 29, 30, 31, 32, and 34.

Pinions 91 and 92 shown in FIG. 24 are rigidly attached to shaft 98. Pinions 91 and 92 engage racks (not shown) attached rigidly to framework of bundle breaker 1. These rack and pinions keep first clamp means 16 horizontal as cylinders 100 extend and retract. It also rotates pinion 97 when the cylinder is raised and lowered. The pinion 97, as shown in FIG. 29, is operatively and selectively connected to racks 90 for selectively separating first and second pressurized structures 21 and 27 shown in FIG. 21 relative to each other, and at right angles and relative to the bundle breaking plane 15 shown in FIG. 2, and along an axis parallel to the direction of movement of the logs 4.

Clamping

Referring to FIG. 6, raising and lowering of first and second clamp means 16 and 17 is by hydraulic cylinders and pistons 100 and 102 respectively.

Second clamp means 17 and second single, wide belt portion 68 must remain parallel during raising, lowering and tilting about axis 103 shown in FIG. 14 mounted on support 104. Hydraulic cylinder and piston 102 is mounted for pivoting about pivot point 114 which moves with the entire tilting section about axis 103.

As shown in FIGS. 1, 2, 13, and 14, second clamp means 17 and second compliance structure 26 pivot about pivot point 103 under the action of hydraulic cylinder and piston 115 pivoting about pivot point 116 shown in FIGS. 1 and 21.

As shown in FIG. 6, chains 107 and 108 and crossed chain 109 engaging sprocket wheels 110 and 111 are part of the mechanism for maintaining second clamp means 17 and second single, wide, belt portion 68 shown in FIG. 5 parallel at all times.

Indexing

A feature of the present invention called "indexing" is best shown in FIGS. 1 and 2 and 13–14. Indexing is the ability of a bundle breaker machine 1 to receive and hold two or more bundles 2 and 3 on the second conveyor 13.

It may be noted that neither Palimac (not patented in the U.S.) or Duecker U.S. Pat. No. 5,927,582, or Vanhoutte, EP 0292067 can index.

The advantage of holding two or more bundles on the second conveyor 13 is that the bundle breaker machine can work much faster if the newly severed bundle 2 does not have to be immediately transferred off the second conveyor 13. Instead, newly broken bundle 3 shown in FIG. 14, is simply advanced or "indexed" to the position shown in FIG. 2.

As second conveyor 13 is discharging bundle 2, and advancing bundle 3, shown in FIG. 14, to the position formerly occupied by bundle 2, first conveyor 10 is advancing the remainder of log 4 to the bundle breaking plane 15 position shown in FIG. 2. Of course first and second clamp means 16 and 17 are in the raised position shown in FIG. 2 during the aforesaid operation.

When remainder of log 4 has reached the position shown in FIG. 2, first and second clamp means 16 and 17 are lowered and tilting occurs about pivot axis 103 as shown in FIG. 14. After the break occurs, second conveyor 13 returns to the horizontal position, and then second conveyor 13 is restarted and bundle 2 is discharged and bundle 3 is advanced.

The reason that indexing is more reliable using Applicants' improved bundle breaker 1 may be seen with respect to FIG. 14. Note that there is considerable separation between bundle 2 and bundle 3. During the tilting of second conveyor 13 and second clamp means 17 if the clamping pressure is not substantially equal on both bundles 2 and 3, the sheets in the bundle held with less force could shift or "fan", making the pile unsteady and more subject to falling during transfer off the bundle breaker 1 and on subsequent conveyors. Even if the bundle does not fall, a bundle which has "fanned" is more difficult to process through subsequent machines which process the bundle. Most of such machines require a straight bundle which is not fanned.

Prior art bundle breakers which tilt the bundle during breaking and which use hard clamping surfaces cannot keep the pressure even on all of the bundles; especially when the bundles are tilted. Note further, that when second conveyor 13 has reached the position shown in FIGS. 13 and 14, the direction of pivoting rotation is immediately reversed, placing further lateral and centrifugal forces on the bundles, especially bundle 2. This reversal of direction can cause fanning of the sheets within the bundle unless the clamp exerts sufficient pressure on the bundle.

The advantages of Applicants improvements in bundle breakers is more apparent when the machines are not only designed to provide indexing, but also attempt to break more than one bundle at a time when they are placed in side by side relation in a row. The combining of these two features is old in the art and is not claimed per se, but Applicant's improved compliance structure greatly improves the reliability of successfully breaking side by side bundles in a row.

The present improvement in a bundle breaker 1 is best shown in 13–16 and in FIGS. 1 and 2. As illustrated , second conveyor 13 and second fluid pressurized structure 27 each have a length sufficient to receive and hold at least four or more bundles 2 and 3 in a row broken successively from a plurality of logs 4 and 4' in side by side relation before discharging one row of bundles 2 from second conveyor 13.

Compliance and Indexing

The reason that Applicants' improvement with the first and second fluid pressurized structures 21 and 27 provide such improved bundle breaking is best shown in FIGS. 13–16.

As shown in Applicants' drawings, there are multiple rows of bundles; i.e. bundle 2 and bundle 3, but there are also multiple bundles in each row. Further, not all the bundles and logs have the same height; presenting a major compliance problem.

Indexed bundles 2 and 3 are widely separated during tilting of second conveyor 13 , and when second conveyor 13 is carrying at least two more side by side bundles in a row which are not illustrated in the drawings. Where any one or more bundles have different heights due to a miscount by an upstream automatic machine, or because a piece of scrap material has become wedged between one more sheets in one or more of the bundles, prior art machines with hard clamp surfaces have great difficulty preventing the sheets in the bundle from fanning as discussed above.

Applicants' second flexible member 28, and plurality of second rigid members 34 , on the other hand, ensures equal pressure on all of the severed bundles at all times, especially during the critical phase when the bundles are being tilted and the sheets are being progressively separated along the weakened lines 8 of each sheet 6. Thus all bundles are held firmly with a minimum of fanning of the sheets in the bundles.

Description of Alternate Structure

The bundle breaker improvement of the present invention described above represents a preferred form of the invention. Other ways of making the bundle breaker improvement may be made and are intended to be covered under the claims.

While the preferred form of the invention uses fluid pressure to detect the height of logs, electrical means such as electric eyes could also be used.

Thus, an improvement in a bundle breaker 1 for shearing progressively a bundle 2 of sheets 6 along a weakened plane 9 from a log 4 may be constructed in which bundle breaker 1 includes first and second adjacent but longitudinally spaced upper 18, 19 and lower 67, 68 clamping surfaces as shown in FIGS. 1 and 30.

Specifically, the upper clamping surfaces 18 and 19 are structurally rigid surfaces of first clamp means 16 and 17 and the lower clamping surfaces 67 and 68 are the previously described first and second single, wide belt portions of first conveyor 10 and second conveyor 13 respectively.

The improvement in a bundle breaker previously described may include: first and second compliance structures 20, and 26 positioned between the first and second, upper clamping surface 18 and 19 and lower clamping surfaces 67 and 68; first and second compliance structures 20 and 26 including first and second detection means 22 and 27 detecting the height of log 4; and variation setting means , including a computer not shown, reducing the distance between upper clamping surfaces 18 and 19 and lower clamping surfaces 67 and 68, a selected increment after detecting the height of the log 4'. In the structure as illustrated and described, whenever any of the first rigid members 33 touch the top surface 5 of the highest log 4, first flexible member 22 is deformed and slightly increases the pressure in first fluid pressurized structure 21. The increase in pressure is sent to a computer (not shown) which signals that the top surface 5 of the highest log 4 has been touched. For simplicity, the foregoing structure consisting of the first flexible member 22, and the first fluid pressurized structure 21 has been referred to as a first detection means 22. In like manner, the second detection means 28 includes second flexible member 28, and second fluid pressurized structure 27.

Still another form of the invention using electric eyes instead of fluid pressure changes to detect the height of the highest log 4' could be constructed to accommodate the processing of logs arranged in rows having a plurality of side by side logs 4 and 4' as follows:

The first and second compliance structures 20 and 26 may be constructed with a width substantially engaging the width of a plurality of logs 4 in a row. At least one of the logs 4' in the row may have a height greater than the other logs 4. The detection means 22 and 27 may consist of electric eyes capable of detecting the log 4' having the greatest height. Finally, the variation setting means (computer not shown) reducing the distance between the upper clamping surfaces 18 and 19 and lower clamping surfaces 67 and 68 a selected increment after detecting said log 4' of greatest height may be a computer or some other device.

We claim:

1. An improvement in a bundle breaker for separating bundles from a log having a generally planar top surface, said log including a plurality of sheets each having a generally planar top surface and each sheet is formed with at least one weakened line, said weakened lines are vertically aligned in said log forming a weakened plane in said log, said bundle breaker including a first conveyor for conveying said log and having an upstream end for receiving said log and a downstream end, and a second conveyor having an upstream end positioned immediately adjacent to said downstream end of said first conveyor providing a gap therebetween defining a bundle breaking plane, said bundle breaker including first clamp means mounted for vertical reciprocating movement above said first conveyor, and second clamp means mounted above said second conveyor for vertical reciprocating movement in relation to said second conveyor and said second conveyor and said second clamp means mounted for conjoint pivotal movement in relation to said bundle breaking plane for progressively breaking a bundle from said log along said weakened plane in said log, said improvement comprising:

a. a first compliance structure mounted on said first clamp means including, (1) a first fluid pressurized structure having a first flexible member presenting a first engagement area for operative engagement with an upstream portion of said generally planar top surface of said log and on the upstream side of said weakened plane in said log; and b. a second compliance structure mounted on said second clamp means including, (1) a second fluid pressurized structure having a second flexible member presenting a second engagement area for operative engagement with a downstream portion of said generally planar top surface of said log and on the downstream side of said weakened plane in said log.

2. An improvement in a bundle breaker as defined in claim 1 wherein:

a. said first and second conveyors have a width sufficient to simultaneously transfer and support a plurality of logs in side by side relation; and b. said first and second compliance structures have a width sufficient to simultaneously engage a plurality of logs in side by side relation.

3. An improvement in a bundle breaker as defined in claim 2 wherein:

a. said first and second compliance structures respectively having first and second fluid pressurized structures for engaging a plurality of logs in side by side relation with at least one log having a height greater than at least one other log.

4. An improvement in a bundle breaker as defined in claim 1 wherein:

a. said first and second flexible members have a width extending substantially the width of said logs and in close proximity to said weakened plane in said log.

5. An improvement in a bundle breaker as defined in claim 1 comprising:

a. said first and second fluid pressurized structures are each formed with a generally planar upper rigid wall affixed to said first and second clamp means, and a depending perimeter wall affixed to and extending downwardly from said generally planar upper rigid wall of said first and second fluid pressurized structures;

b. said first and second flexible members are joined to said respective perimeter walls in pressure sealing engagement therewith; and c. said first and second engagement areas of said first and second flexible members each present a substantially planar unbroken surface area with infinite indentation flexibility upon the application of forces to any portion of said substantially planar unbroken surface area.

6. An improvement in a bundle breaker as defined in claim 1 or claim 2 comprising:

a. means for varying the pressure in each of said first and second fluid pressurized structures.

7. An improvement in a bundle breaker as defined in claim 1 or claim 2 comprising:

a. a plurality of first and second closely spaced rigid members operatively engaged by said first and second flexible members and having generally flat portions for engaging said logs.

8. An improvement in a bundle breaker as defined in claim 1 comprising:

a. said plurality of first and second rigid members extend generally in the longitudinal direction of said log.

9. An improvement in a bundle breaker as defined in claim 1 comprising:

a. first limiting means limiting the vertical movement of said first and second plurality of rigid members.

10. An improvement in a bundle breaker as defined in claim 1 comprising a. second limiting means limiting the horizontal movement of said first and second plurality of rigid members.

11. An improvement in a bundle breaker as defined in claim 9 comprising:

a. said first limiting means including a generally planar rigid member having a strength sufficient to maintain a generally planar surface during maximum clamping force; and b. a plurality of first c-shaped members arranged in parallel separated positions parallel to said rigid members;

c. a plurality of second c-shaped members interlocking with said first c-shaped members; and d. each of said rigid members is individually attached to one of said second c-shaped members.

12. An improvement in a bundle breaker as defined in claim 5 comprising:

a. said generally planar upper rigid walls of said first and second fluid pressurized structures are each slidably affixed to said respective first and second clamp means for movement parallel to the direction of travel of said logs;

b. gear engagement means mounted respectively on said first and second fluid pressure structures; and c. control means operatively engaging each of said gear engagement means for selectively separating said first and second pressurized structures relative to each other, and at right angles and relative to said bundle breaking plane, and along an axis parallel to the direction of movement of said logs.

13. An improvement in a bundle breaker as defined in claim 1 wherein:

a. said second conveyor and said second fluid pressurized structure each have a length to receive and hold at least two bundles broken successively from a single bundle before discharging at least one of said bundles from said second conveyor.

14. An improvement in a bundle breaker as defined in claim 2 wherein:

a. said second conveyor and said second fluid pressurized structure each have a length sufficient to receive and hold at least two or more rows of bundles broken successively from a plurality of logs in side by side relation before discharging at least one of said rows of bundles from said second conveyor.

15. An improvement in a bundle breaker as defined in claim 1 comprising:

a. means for transmitting a difference in air pressure in at least said first fluid pressurized structure to a computer means when said first fluid pressurized structure first contacts said log when said first clamp means is lowered.

16. An improvement in a bundle breaker for shearing progressively a bundle of sheets along a weakened plane from a log, said bundle breaker including first and second adjacent but longitudinally spaced upper and lower clamping surfaces, the improvement comprising:

a. first and second compliance structures positioned between said first and second, upper and lower clamping surfaces;

b. said first and second compliance structures including first and second detection means detecting the height of said log;

c. variation setting means reducing the distance between said upper and lower clamping surfaces a selected increment after detecting the height of said log.

17. An improvement in a bundle breaker as defined in claim 16 wherein:

a. said first and second compliance structures having a width substantially engaging the width of a plurality of logs in a row;

b. at least one of said logs in said row having a height greater than said other logs;

c. said detection means is capable of detecting said log having the greatest height; and d. said variation setting means reducing the distance between said upper and lower clamping surfaces a selected increment after detecting said log of greatest height.

* * * * *

UNITED STATES PATENT AND TRADEMARK OFFICE

CERTIFICATE OF CORRECTION

PATENT NO. : 6,655,566 B1
DATED : December 2, 2003
INVENTOR(S) : Merrill D. Martin and Daniel J. Talken It is certified that error appears in the above-identified patent and that said Letters Patent is hereby corrected as shown below:

Title page,
Item [56], References Cited, FOREIGN PATENT DOCUMENTS, replace "1 292 067 B2" with -- 0 292 067 B2 --.

Signed and Sealed this

Sixth Day of July, 2004

JON W. DUDAS
*Acting Director of the United States Patent and Trademark Office*